US006972110B2

(12) United States Patent
Chakrabarti et al.

(10) Patent No.: US 6,972,110 B2
(45) Date of Patent: Dec. 6, 2005

(54) ALUMINUM ALLOY PRODUCTS HAVING IMPROVED PROPERTY COMBINATIONS AND METHOD FOR ARTIFICIALLY AGING SAME

(75) Inventors: Dhruba J. Chakrabarti, Export, PA (US); John Liu, Lower Burrell, PA (US); Jay H. Goodman, Murrysville, PA (US); Gregory B. Venema, Bettendorf, IA (US); Ralph R. Sawtell, Brecksville, OH (US); Cynthia M. Krist, Bettendorf, IA (US); Robert W. Westerlund, Bettendorf, IA (US)

(73) Assignee: Alcoa Inc., Pittsburgh, PA (US)

( * ) Notice: Subject to any disclaimer, the term of this patent is extended or adjusted under 35 U.S.C. 154(b) by 365 days.

(21) Appl. No.: 09/971,456

(22) Filed: Oct. 4, 2001

(65) Prior Publication Data

US 2002/0121319 A1 Sep. 5, 2002

Related U.S. Application Data

(63) Continuation-in-part of application No. 09/773,270, filed on Jan. 31, 2001, now abandoned.
(60) Provisional application No. 60/257,226, filed on Dec. 21, 2000.

(51) Int. Cl.[7] ..... C22C 22/00
(52) U.S. Cl. ..... 420/532; 420/552; 148/417
(58) Field of Search ..... 420/532, 552, 420/553; 148/417

(56) References Cited

U.S. PATENT DOCUMENTS

| | | | |
|---|---|---|---|
| 3,135,633 A | 6/1964 | Hornus | 148/159 |
| 3,542,606 A | 11/1970 | Westerman et al. | 148/12.7 |

FOREIGN PATENT DOCUMENTS

| | | |
|---|---|---|
| DE | 2932374 | 2/1981 |
| EP | 829552 | 3/1998 |
| EP | 377779 | 5/1998 |
| FR | 2744136 | 8/1997 |
| JP | 58[1983]-161747 | 9/1983 |
| JP | 58[1983]-213852 | 12/1983 |
| JP | 59[1984]-28555 | 2/1984 |

OTHER PUBLICATIONS

"Aluminum and Aluminum Alloys", ASM International, 1993, p 124.*
"Aluminum and Aluminum Alloys", pp 23–24.*
"Metals Handbook: Desk Edition", 2nd ed., ASM International, (1998), pp 419–421.*
Shahani, R. et al., "High Strength 7XXX Alloys for Ultra–Thick Aerospace Plate: Optimisation of Alloy Composition", Aluminum Alloys, vol. 2, pp. 1105–1110.

(Continued)

*Primary Examiner*—George Wyszomierski
*Assistant Examiner*—Janelle Morillo
(74) *Attorney, Agent, or Firm*—D. Mark Maloney; Eckert Seamans Cherin & Mellott, LLC

(57) ABSTRACT

Aluminum alloy products, such as plate, forgings and extrusions, suitable for use in making aerospace structural components like integral wing spars, ribs and webs, comprises about: 6 to 10 wt. % Zn; 1.2 to 1.9 wt. % Mg; 1.2 to 2.2 wt. % Cu, with Mg≦(Cu+0.3); and 0.05 to 0.4 wt. % Zr, the balance Al, incidental elements and impurities. Preferably, the alloy contains about 6.9 to 8.5 wt. % Zn; 1.2 to 1.7 wt. % Mg; 1.3 to 2 wt. % Cu. This alloy provides improved combinations of strength and fracture toughness in thick gauges. When artificially aged per the three stage method of preferred embodiments, this alloy also achieves superior SCC performance, including under seacoast conditions.

128 Claims, 14 Drawing Sheets

U.S. PATENT DOCUMENTS

| | | | | |
|---|---|---|---|---|
| 3,645,804 | A | 2/1972 | Ponchel | 148/128 |
| 3,856,584 | A | 12/1974 | Cina | 148/159 |
| 3,881,966 | A | 5/1975 | Staley et al. | 370/159 |
| 3,945,860 | A | 3/1976 | Winter et al. | 148/11.5 |
| 3,947,297 | A | 3/1976 | Reimann et al. | 148/159 |
| 4,189,334 | A | 2/1980 | Dubost et al. | 148/159 |
| 4,200,476 | A | 4/1980 | Dubost et al. | 148/12.7 A |
| 4,294,625 | A | 10/1981 | Hyatt et al. | 148/2 |
| 4,323,399 | A | 4/1982 | Dubost et al. | 148/12.7 A |
| 4,345,951 | A | 8/1982 | Coupry et al. | 148/2 |
| 4,431,467 | A | 2/1984 | Staley et al. | 148/159 |
| 4,477,292 | A | 10/1984 | Brown | 148/20 |
| 4,488,913 | A | 12/1984 | Ferton | 148/12.7 A |
| 4,618,382 | A | 10/1986 | Miyagi et al. | 148/415 |
| 4,648,913 | A | 3/1987 | Hunt et al. | 148/12.7 A |
| 4,747,890 | A | 5/1988 | Meyer | 148/439 |
| 4,797,165 | A | 1/1989 | Bretz et al. | 148/12.7 A |
| 4,816,087 | A | 3/1989 | Cho | 148/2 |
| 4,828,631 | A | 5/1989 | Ponchel et al. | 148/417 |
| 4,832,758 | A | 5/1989 | Brown | 148/12.7 A |
| 4,863,528 | A | 9/1989 | Brown et al. | 148/12.7 A |
| 4,946,517 | A | 8/1990 | Cho | 148/12.7 A |
| 4,954,188 | A | 9/1990 | Ponchel et al. | 148/417 |
| 5,066,342 | A | 11/1991 | Rioja et al. | 148/12.7 A |
| 5,108,520 | A | 4/1992 | Liu et al. | 148/12.7 R |
| 5,110,372 | A | 5/1992 | Faure | 148/552 |
| RE34,008 | E | 7/1992 | Quist et al. | 148/417 |
| 5,151,136 | A | 9/1992 | Witters et al. | 148/689 |
| 5,213,639 | A | 5/1993 | Colvin et al. | 148/693 |
| 5,221,377 | A | 6/1993 | Hunt et al. | 148/417 |
| 5,240,522 | A | 8/1993 | Tanaka et al. | 148/693 |
| 5,277,719 | A | 1/1994 | Kuhlman et al. | 148/694 |
| 5,413,650 | A | 5/1995 | Jarrett et al. | 148/690 |
| 5,560,789 | A | 10/1996 | Sainfort et al. | 148/549 |
| 5,759,302 | A | 6/1998 | Nakai et al. | 148/415 |
| 5,865,911 | A | 2/1999 | Miyasato et al. | 148/439 |
| 6,027,582 | A | 2/2000 | Shahani et al. | 148/417 |
| 6,048,415 | A | 4/2000 | Nakai et al. | 148/417 |
| 6,342,111 | B1 | 1/2002 | Meki et al. | 148/417 |

OTHER PUBLICATIONS

"Aluminum Wrought Products", Metals Handbook, Second Edition, 1998, pp. 422, 445–460.

Warner, T.J. et al., "Aluminum Alloy Developments for Affordable Airframe Structures", Third ASM International Paris Conference on Synthesis, Processing and Modelling of Advanced Materials, pp. 79–88.

"A New Approach to the Problem of Stress Corrosion Cracking in 7075–T6 Aluminum" by W. Wallace (Canadian Aeronautics & Space Journal, vol. 27, No. 3, pp. 222–232).

"Retrogression and Reaging Response of 7475 Aluminium Alloy" by Islam et al. (Metals Technology, Oct. 1983, vol. 10, pp. 386–392).

"Microstructural Study of a High–Strength Stress–Corrosion Resistant 7075 Aluminium Alloy" by Rajan et al. (Journal of Materials Science 17 (1982), pp. 2817–2824)).

* cited by examiner

Figure 12 - Invention Alloy Plate Open-Hole S/N Fatigue for L-T Orientation
Kt=2.3, R=0.1, Freq.=30 Hz, RH>90%

ALUMINUM ALLOY PRODUCTS HAVING IMPROVED PROPERTY COMBINATIONS AND METHOD FOR ARTIFICIALLY AGING SAME

CROSS REFERENCE TO RELATED APPLICATIONS

This application claims the benefit of U.S. Provisional Application Ser. No. 60/257,226, filed on Dec. 21, 2000, and further claims to be a continuation-in-part of U.S. application Ser. No. 09/773,270, filed on Jan. 31, 2001, now abandoned, both disclosures of which are incorporated by reference herein.

FIELD OF THE INVENTION

This invention relates to aluminum alloys, particularly 7000 Series (or 7XXX) aluminum ("Al") alloys as designated by the Aluminum Association. More particularly, the invention relates to Al alloy products in relatively thick gauges, i.e. about 2–12 inches thick. While typically practiced on rolled plate product forms, this invention may also find use with extrusions or forged product shapes. Through the practice of this invention, parts made from such thick-sectioned starting materials/products have superior strength—toughness property combinations making them suitable for structural parts in various aerospace applications as thick gauge parts or as parts with thinner sections machined from thick material. Valuable improvements in corrosion resistance performance have also been imparted by the invention, particularly with respect to stress corrosion cracking (or "SCC") resistance. Representative structural component parts made from this alloy include integral spar members and the like which are machined from thick wrought sections, including rolled plate. Such spar members can be used in the wingboxes of high capacity aircraft. This invention is particularly suitable for manufacturing high strength extrusions and forged aircraft components, such as, for example, main landing gear beams. Such aircraft include commercial passenger jetliners, cargo planes (as used by overnight mail service providers) and certain military planes. To a lesser degree, the alloys of this invention are suitable for use in other aircraft including but not limited to turbo prop planes. In addition, non-aerospace parts like various cast thick mold plates may be made according to this invention.

As the size of new jet aircraft get larger, or as current jetliner models grow to accommodate heavier payloads and/or longer flight ranges to improve performance and economy, the demand for weight savings of structural components, such as fuselage, wing and spar parts continues to increase. The aircraft industry is meeting this demand by specifying higher strength, metal parts to enable reduced section thicknesses as a weight savings expedient. In addition to strength, the durability and damage tolerance of materials are also critical to an aircraft's fail-safe structural design. Such consideration of multiple material attributes for aircraft applications eventually led to today's damage tolerant designs, which combine the principles of fail-safe design with periodic inspection techniques.

A traditional aircraft wing structure comprises a wing box generally designated by numeral 2 in accompanying FIG. 1. It extends outwardly from the fuselage as the main strength component of the wing and runs generally perpendicular to the plane of FIG. 1. That wing box 2 comprises upper and lower wing skins 4 and 6 spaced by vertical structural members or spars 12 and 20 extending between or bridging upper and lower wing skins. The wing box also includes ribs which can extend generally from one spar to the other. These ribs lie parallel to the plane of FIG. 1 whereas the wing skins and spars run perpendicular to said FIG. 1 plane. During flight, the upper wing structures of a commercial aircraft wing are compressively loaded, calling for high compressive strengths with an acceptable fracture toughness attribute. The upper wing skins of today's most large aircraft are typically made from 7XXX series aluminum alloys such as 7150 (U.S. Reissue Pat. No. 34,008) or 7055 aluminum (U.S. Pat. No. 5,221,377). Because the lower wing structures of these same aircraft wings are under tension during flight, they will require a higher damage tolerance than their upper wing counterparts. Although one might desire to design lower wings using a higher strength alloy to maximize weight efficiency, the damage tolerance characteristics of such alloys often fall short of design expectations. As such, most commercial jetliner manufacturers today specify a more damage-tolerant 2XXX series alloy, such as 2024 or 2324 aluminum (U.S. Pat. No. 4,294,625), for their lower wing applications, both of said 2XXX alloys being lower in strength than their upper wing, 7XXX series counterparts. The alloy members and temper designations used throughout are in accordance with the well-known product standards of the Aluminum Association.

Upper and lower wing skins, 4 and 6 respectively, from accompanying FIG. 1 are typically stiffened by longitudinally extending stringer members 8 and 10. Such stringer members may assume a variety of shapes, including "J", "I", "L", "T" and/or "Z" cross sectional configurations, These stringer members are typically fastened to a wing skin inner surface as shown in FIG. 1, the fasteners typically being rivets. Upper wing stringer member 8 and upper spar caps 14 and 22 are presently manufactured from a 7XXX series alloy, with lower wing stringer 10 and lower spar caps 16 and 24 being made from a 2XXX series alloy for the same structural reasons discussed above regarding relative strength and damage-tolerance. Vertical spar web members 18 and 26, also made from 7XXX alloys, fasten to both upper and lower spar caps while running in the longitudinal direction of the wing constituted by member spars 12 and 20. This traditional spar design is also known as a "built-up" spar, comprising upper spar cap 14 or 22, web 18 or 20, and lower spar cap 16 or 24, with fasteners (not shown). Obviously, the fasteners and fastener holes at the joints to this spar are structural weak links. In order to ensure the structural integrity of a built-up spar like 18 or 20, many component parts like the web and/or spar cap have to be thickened, thereby adding weight to the overall structure.

One potential design approach for overcoming the aforementioned spar weight penalty is to make an upper spar, web and lower spar by machining from a thick simple section, such as plate, of aluminum alloy product, typically by removing substantial amounts of metal to make a more complex, less thick section or shape such as a spar. Sometimes, this machining operation is known as "hogging out" the part from its plate product. With such a design, one could eliminate the need for making web-to-upper spar and web-to-lower spar joints. A one-piece spar like that is sometimes known as an "integral spar" and can be machined from a thick plate, extrusion or forging. Integral spars should not only weigh less than their built up counterparts; they should also be less costly to make and assemble by eliminating the need for fasteners. An ideal alloy for making integral spars should have the strength characteristics of an upper wing alloy combined with the fracture toughness/damage tolerance requirements of a lower wing alloy. Existing commercial alloys used on aircraft do not satisfy this combination of preferred property requirements. The lower strengths of lower wing skin alloy 2024-T351, for example, will not safely carry the load transmittals from a highly loaded, upper wing unless its section thicknesses are significantly increased. That, in turn, would add undesirable weight to the overall wing structure. Conversely, designing an upper wing to 2XXX strength capabilities would result in an overall weight penalty.

Large jet aircrafts require very large wings. Making integral spars for such wings would require products as thick as 6 to 8 inches or more. Alloy 7050-T74 is often used for thick sections. The industry standard for 6 inch thick 7050-T7451 plate, as listed in Aerospace Materials Specification AMS 4050F, specifies a minimum yield strength in the longitudinal (L) direction of 60 ksi and a plane-strain fracture toughness, or $K_{Ic}$(L-T), of 24 ksi√in. For that same alloy temper and thickness, specified values in the transverse direction (LT and T-L) are 60 ksi and 22 ksi√in, respectively. By comparison, the more recently developed upper wing alloy, 7055-T7751 aluminum, about 0.375 to 1.5 inches thick, can meet a minimum yield strength of 86 ksi according to MIL-HDBK-5H. If an integral spar of 7050-T74, with a 60 ksi minimum yield strength is used with the aforesaid 7055 alloy, overall strength capabilities of that upper wing skin would not be taken full advantage of for maximum weight efficiencies. Hence, higher strength, thick aluminum alloys with sufficient fracture toughness are needed for manufacturing the integral spar configurations now desired for new jetliner designs. This is but one specific example of the benefits of an aluminum material with high strength and toughness in thick sections, but many others exist in modem aircraft, such as the wing ribs, webs or stringers, wing panels or skins, the fuselage frame, floor beam or bulkheads, even landing gear beams or various combinations of these aircraft structural components.

The varying tempers that result from different artificial aging treatments are known to impart different levels of strength and other performance characteristics including corrosion resistance and fracture toughness. 7XXX series alloys are most often made and sold in such artificially aged conditions as "peak" strength ("T6-type") or "over-aged" ("T7-type") tempers. U.S. Pat. Nos. 4,863,528, 4,832,758, 4,477,292 and 5,108,520 each describe 7XXX series alloy tempers with a range of strength and performance property combinations. All of the contents of those patents are fully incorporated by reference herein.

It is well known to those skilled in the art that for a given 7XXX series wrought alloy, peak strength or T6-type tempers provide the highest strength values, but in combination with comparatively low fracture toughness and corrosion resistance performance. For these same alloys, it is also known that most over-aged tempering, like a typical T73-type temper, will impart the highest fracture toughness and corrosion resistance but at a significantly lower relative strength value. When making a given aerospace part, therefore, part designers must select an appropriate temper somewhere between the aforesaid two extremes to suit that particular application. A more complete description of tempers, including the "T-XX" suffix, can be found in the Aluminum Association's *Aluminum Standards and Data* 2000 publication as is well known in the art.

Most aerospace alloy processing requires a solution heat treatment (or "SHT") followed by quenching and subsequent artificial aging to develop strength and other properties. However, seeking improved properties in thick sections faces two natural phenomena. First, as a product shape thickens, the quench rate experienced at the interior cross section of that product naturally decreases. That decrease, in turn, results in a loss of strength and fracture toughness for thicker product shapes, especially in inner regions across the thickness. Those skilled in the art refer to this phenomenon as "quench sensitivity". Second, there is also a well known, inverse relationship between strength and fracture toughness such that as component parts are designed for ever greater strength loads, their relative toughness performance decreases . . . and vice versa.

To better understand the present invention, certain demonstrated trends in the art of commercial aerospace 7XXX series alloys are worth considering. Aluminum alloy 7050, for example, substitutes Zr for Cr as a dispersoid agent for greater grain structure control and increases both Cu and Zn contents over the older 7075 alloy. Alloy 7050 provided a significant improvement in (i.e. by decreasing) quench sensitivity over its 7075 alloy predecessor, thereby establishing 7050 aluminum as the mainstay for thick-sectioned aerospace applications in plate, extrusion and/or forged shapes. For upper wing applications with still higher strength-toughness requirements, the compositional minimums for both Mg and Zn in 7050 aluminum were slightly raised to make an Aluminum Association-registered 7150 alloy variant of 7050. Compared to its 7050 predecessor, the minimum Zn contents for 7150 increased from 5.7 to 5.9 wt. %, and Mg level minimums rose from 1.9 to 2.0 wt. %.

Eventually, a newer upper wing skin alloy was developed. That alloy 7055 exhibited a 10% improvement in compression yield strength, in part, by employing a higher range of Zn, from 7.6 to 8.4 wt %, with a similar Cu level and slightly lower Mg range (1.8 to 2.3 wt %) compared to either alloy 7050 or 7150.

Past efforts for still higher strengths (by increasing alloying components and compositional optimizations), had to be offset with metal purity increases and microstructure control through thermal-mechanical processing ("TMP") to obtain improvements in toughness and fatigue life among other properties. U.S. Pat. No. 5,865,911 reported a significant improvement in toughness, at equivalent strengths, for a 7XXX series alloy plate. However, the quench sensitivity of that alloy, in thicker gauges, is believed to cause other noticeable property disadvantages.

Alloy 7040, as registered with the Aluminum Association, calls for the following ranges of main alloying components: 5.7–6.7 wt. % Zn, 1.7–2.4 wt. % Mg and 1.5–2.3 wt. % Cu. Related literature, namely Shahani et al., "High Strength 7XXX Alloys For Ultra-Thick Aerospace Plate: Optimization of Alloy Composition," *PROC. ICAA* 6, v. 2, pp/105–1110 (1998) and U.S. Pat. No. 6,027,582, state that 7040 developers pursued an optimization balance between alloying elements for improving strength and other properties while avoiding excess additions to minimize quench sensitivity. While thicker gauges of alloy 7040 claimed some property improvements over 7050, those improvements still fall short of newer commercial aircraft designer needs.

This invention differs in several key ways from the alloys currently being supplied on a commercial basis for aerospace-type applications. Main alloying elements for several current commercial 7XXX aerospace alloys, as listed by the Aluminum Association, are as follows:

TABLE 1

| Comp #/wt. % | Zn | Mg | Cu | Zr | Cr |
|---|---|---|---|---|---|
| 7075 | 5.1–6.1 | 2.1–2.9 | 1.2–2.0 | — | 0.18–0.28 |
| 7050 | 5.7–6.7 | 1.9–2.6 | 2.0–2.6 | 0.08–0.15 | 0.04 max |
| 7010 | 5.7–6.7 | 2.1–2.6 | 1.5–2.0 | 0.1–0.16 | 0.05 max* |
| 7150 | 5.9–6.9 | 2.0–2.7 | 1.9–2.5 | 0.08–0.15 | 0.04 max |
| 7055 | 7.6–8.4 | 1.8–2.3 | 2.0–2.6 | 0.08–0.25 | 0.04 max |
| 7040 | 5.7–6.7 | 1.7–2.4 | 1.5–2.3 | 0.05–0.12 | 0.05 max* |

*included in the "0.05% each/0.15% total" for unlisted impurities
Note that alloys 7075, 7050, 7010 and 7040 aluminum are supplied to the aerospace industry in both thick and thin (up to 2 inches) gauges; the others (7150 and 7055) are generally supplied in thin gauge. By contrast with these commercial alloys, a preferred alloy in accordance with the invention contains about 6.9 to 8.5 wt. % Zn, 1.2 to 1.7 wt. % Mg, 1.3 to 2 wt. % Cu, 0.05 to 0.15 wt. % Zr, the balance essentially aluminum, incidental elements and impurities.

This invention solves the aforesaid prior art problems with a new 7XXX series aluminum alloy that, in thicker gauges, exhibits significantly reduced quench sensitivity so as to provide significantly higher strength and fracture toughness levels than heretofore possible. The alloy of this invention has a relatively high zinc (Zn) content coupled with lower copper (Cu) and magnesium (Mg) in comparison with the commercial 7XXX aerospace alloys above. For this invention, combined Cu+Mg is usually less than about 3.5%, and preferably less than about 3.3%. When the aforesaid compositions are subjected to the preferred 3-stage aging practice outlined in greater detail below, the resulting thick wrought product forms (either plate, extrusions or forgings) are shown to exhibit a highly desirable combination of strength, fracture toughness and fatigue performance, in further combination with superior stress corrosion cracking (SCC) resistance, particularly when subjected to atmospheric, seacoast type test conditions.

Prior art examples for aging 7XXX Al alloys in three steps or stages are known. Representative are U.S. Pat. Nos. 3,856,584, 4,477,292, 4,832,758, 4,863,528 and 5,108,520. The first step/stage for many of the aforementioned prior art processes was typically performed at around 250° F. The preferred first step for the alloy composition of this invention ages between about 150–275° F., preferably between about 200–275° F., and more preferably from about 225 or 230° F. to about 250 or 260° F. This first step or stage can include two temperatures, such as 225° F. for about 4 hours, plus 250° F. for about 6 hours, both of which count only as the "first stage", i.e. the stage preceding the second (e.g. about 300° F.) stage described below. Most preferably, the first aging step of this invention operates at about 250° F., for at least about 2 hours, preferably for about 6 to 12, and sometimes for as much as 18 hours or more. It should be noted, however, that shorter holding times can suffice depending on part size (i.e. thickness) and shape complexity, coupled with the degree to which equipment ramp up temperatures (i.e. relatively slow heat up rates) may be employed in conjunction with short hold times at temperature for these alloys.

Preferred second steps in some prior art, 3 step artificial aging practices normally took place above about 350 or 360° F. or higher, followed by a third step age similar to their first step, at about 250° F. By contrast, the preferred second aging stage of this invention differs by proceeding at significantly lower temperatures, about 40 to 50° F. lower. For preferred embodiments of this 3-stage aging method on the 7XXX alloy compositions specified herein, the second of three stages or steps should take place from about 290 or 300° F. to about 330 or 335° F. More particularly, that second aging step or stage should be performed between about 305 and 325° F., with a more preferred second step aging range occurring between about 310 to 320 or 325° F. Preferred exposure times for this second step processing depend inversely on the temperature(s) employed. For instance, if one were to operate substantially at or very near 310° F., a total exposure time from about 6 to 18 hours would suffice. More preferably, second stage agings should proceed for about 8 or 10 to 15 total hours at that operating temperature. At a temperature of about 320° F., total second step times can range between about 6 to 10 hours with about 7 or 8 to 10 or 11 hours being preferred. There is also a preferred target property aspect to second step aging time and temperature selection. Most notably, shorter treatment times at a given temperature favor relatively higher strength values whereas longer exposure times favor better corrosion resistance performance.

The foregoing second stage age is then followed by a third aging stage at a lower temperature. One preferably should not ramp slowly down from the second step for performing this third step on thicker workpieces unless extreme care is exercised to coordinate closely with the second step temperature and total time duration so as to avoid exposures at higher (second stage type) temperatures for too long. Between the second and third aging steps, the metal products of this invention can be purposefully removed from the heating furnace and rapidly cooled, using fans or the like, to either about 250° F. or less, perhaps even fully back down to room temperature. In any event, the preferred time/temperature exposures for the third aging stage of this invention closely parallel those set forth for the first aging step above, at about 150–275° F., preferably between about 200–275° F., and more preferably from about 225 or 230° F. to about 250 or 260° F. And while the aforementioned method improves particular properties, especially SCC resistance, for this new family of 7XXX alloys, it is to be understood that similar combinations of property improvements may be realized by practicing this same 3-step aging method on still other 7XXX alloys, including but not limited to 7×50 alloys (either 7050 or 7150 aluminum), 7010 and 7040 aluminum.

For newer and larger airplanes, manufacturers strongly desire thick sectioned, aluminum alloy products with compressive yield strengths about 10–15% higher than those routinely achieved by incumbent alloys 7050, 7010 and/or 7040 aluminum. In response to this need, the present invention 7XXX-type alloy meets the aforementioned yield strength goals while surprisingly possessing attractive fracture toughness performance. In addition, this alloy has exhibited excellent stress corrosion cracking resistance when aged by the preferred three stage, artificial aging practices specified herein. Samples of six inch thick plate made from this alloy passed laboratory scale, 3.5% salt solution alternate immersion (or "Al") stress corrosion cracking (SCC) tests. Pursuant to those tests, thick metal samples had to survive at least 30 days without cracking at a minimum stress of 25 ksi imposed in the short transverse (or "ST") direction for meeting the T76 tempering conditions currently specified by one major jetliner manufacturer. These thicker metal samples have also met other static and dynamic property goals of that jetliner manufacturer.

While meeting an initial wave of laboratory alternate immersion (Al) SCC tests at the even higher stress levels of 35 to 45 ksi, the thick alloys samples of this invention, artificially aged by then known two step tempering practices, exhibited some unexpected corrosion-related failures, some at even 25 ksi stress levels, when first exposed to seacoast SCC test conditions. This was even surprising since laboratory-accelerated, Al SCC tests historically correlated well with atmospheric tests, both seacoast and industrial. Under these industrial tests, samples of this invention alloy when aged in 3 stages as described herein for the invention did not fail after 11 months seacoast exposure to both 25 and 35 ksi stress levels. Even though atmospheric SCC performance has not been expressly required by aircraft manufacturers' next generation plane specifications, it nevertheless is considered important for critical aerospace applications like the spars and ribs of a jetliner's wingbox. Thus while products aged in two stages may be adequate, the practice of this invention prefers the herein described three stage artificial aging.

One known "fix" for improving the SCC resistance of some 7XXX alloys has been to overage the material, but at a typical tradeoff in strength reduction. That sort of strength tradeoff is undesirable for an integral wing spar because that thick machined part will still have to meet fairly high compressive yield strength standards. Thus, there is a clear need for developing an artificial aging practice that won't unduly sacrifice strength properties while still improving the corrosion resistance of high performance, 7XXX aluminum alloys. In particular, it is desirable to develop an aging method that will raise the seacoast SCC performance of these alloys to better levels without compromising strength and/or other property combinations. The above described three stage aging method of the invention satisfies this need.

An important aspect of this invention focuses on a newly developed, aluminum alloy that exhibits significantly reduced quench sensitivity in thick gauges, i.e., greater than about 2 inches and, more preferably, in thicknesses ranging from about 4 to 8 inches or greater. A broad compositional breakdown for that alloy consists essentially of: from about 6% Zn to about 9, 9.5 or 10 wt. % Zn; from about 1.2 or 1.3% Mg to about 1.68, 1.7 or even 1.9 wt. % Mg; from about 1.2, 1.3 or 1.4 wt. % Cu to about 1.9, or even 2.2 wt. % Cu, with % Mg≦(% Cu+0.3 max.); one or more element being present selected from the group consisting of: up to about 0.3 or 0.4 wt % Zr, up to about 0.4 wt. % Sc, and up to about 0.3 wt. % Hf, the balance essentially aluminum and incidental elements and impurities. Except where stated otherwise such as "being present", the expression "up to" when referring to the amount of an element means that that elemental composition is optional and includes a zero amount of that particular compositional component. Unless stated otherwise, all compositional percentages are in weight percent (wt. %).

When used herein, the term "substantially free" means that no purposeful additions of that alloying element were made to the composition, but that due to impurities and/or leaching from contact with manufacturing equipment, trace quantities of such elements may, nevertheless, find their way into the final alloy product. It is to be understood, however, that the scope of this invention should not/cannot be avoided through the mere addition of any such element or elements in quantities that would not otherwise impact on the combinations of properties desired and attained herein.

When referring to any numerical range of values, such ranges are understood to include each and every number and/or fraction between the stated range minimum and maximum. A range of about 6 to 10 wt % zinc, for example, would expressly include all intermediate values of about 6.1, 6.2, 6.3 and 6.5%, all the way up to and including 9.5, 9.7 and 9.9% Zn. The same applies to each other numerical property, thermal treatment practice (i.e. temperature) and/or elemental range set forth herein. Maximum or "max" refers to a total value up to the stated value for elements, times and/or other property values, as in a maximum of 0.04 wt. % Cr; and minimum; "min" refers to all values above the stated minimum value.

The term "incidental elements" can include relatively small amounts of Ti, B, and others. For example, titanium with either boron or carbon serves as a casting aid, for grain size control. The invention herein may accommodate up to about 0.06 wt. % Ti, or about 0.01 to 0.06 wt. % Ti and optionally up to: about 0.001 or 0.03 wt. % Ca, about 0.03 wt. % Sr and/or about 0.002 wt. % Be as incidental elements. Incidental elements can also be present in significant amounts and add desirable or other characteristics on their own without departing from the scope of the invention so long as the alloy retains the desirable characteristics set forth herein, including reduced quench sensitivity and improved property combinations.

This alloy can further contain other elements to a lesser extent and on a less preferred basis. Chromium is preferably avoided, i.e. kept at or below about 0.1 wt. % Cr. Nevertheless, it is possible that some very small amounts of Cr may contribute some value for one or more specific applications of this invention alloy. Presently preferred embodiments keep Cr below about 0.05 wt. %. Manganese is also kept purposefully low, below about 0.2 or 0.3 total wt. % Mn, and preferably not over about 0.05 or 0.1 wt. % Mn. Still, there may be one or more specific applications of this invention alloy where purposeful Mn additions may make a positive contribution.

For the alloy, minor amounts of calcium may be incorporated therein, primarily as a good deoxidizing element at the molten metal stages. Ca additions of up to about 0.03 wt. %, or more preferably about 0.001–0.008 wt. % (or 10 to 80 ppm) Ca, also assist in preventing larger ingots cast from the aforesaid composition from cracking unpredictably. When cracking is less critical, as for round billets for forged parts and/or extrusions, Ca need not be added hereto, or may be added in smaller amounts. Strontium (Sr) can be used as a substitute for, or in combination with the aforesaid Ca amounts for the same purposes. Traditionally, beryllium additions has served as a deoxidizer/ingot cracking deterrent. Though for environmental, health and safety reasons, more preferred embodiments of this invention are substantially Be-free.

Iron and Silicon contents should be kept significantly low, for example, not exceeding about 0.04 or 0.05 wt. % Fe and about 0.02 or 0.03 wt. % Si or less. In any event, it is conceivable that still slightly higher levels of both impurities, up to about 0.08 wt. % Fe and up to about 0.06 wt. % Si may be tolerated, though on a less preferred basis herein. Even less preferred, but still tolerable, Fe levels of about 0.15 wt. % and Si levels as high as about 0.12 wt. % may be present in the alloy of this invention. For the mold plates embodiments hereof, even higher levels of up to about 0.25 wt. % Fe, and about 0.25 wt. % Si or less, are tolerable.

As is known in the art of 7XXX Series, aerospace alloys, iron can tie up copper during solidification. Hence, there are periodic references throughout this disclosure to an "Effective Cu" content, that is the amount of copper NOT tied up by iron present, or restated, the amount of Cu actually available for solid solution and alloying. In some instances, therefore, it can be advantageous to consider the effective amount of Cu and/or Mg present in the invention, then correspondingly adjust (or raise) the range of actual Cu and/or Mg measured therein to account for the levels of Fe and/or Si contents present and possibly interfering with Cu, Mg or both. For example, raising the preferred amount of Fe content acceptable from about 0.04 or 0.05 wt % to about 0.1 wt. % maximum can make it advantageous to raise the actual, measurable Cu minimums and maximums specified by about 0.13 wt. %. Manganese acts in a similar manner to copper with iron present. Similarly for magnesium, it is known that silicon ties up Mg during the solidification of 7XXX Series alloys. Hence, it can be advantageous to refer to the amount of Mg present in this disclosure as an "Effective Mg" by which is meant that amount of Mg not tied up by Si, and thus available for solution at the temperature or temperatures used for solutionizing 7XXX alloys. Like the aforesaid actual adjusted Cu ranges, raising the preferred allowable maximum Si content from about 0.02 to about 0.08 or even 0.1 or 0.12 wt. % Si could cause the acceptable/measurable amounts (both max and min) of Mg present in this invention alloy to be similarly adjusted upwardly, perhaps on the order of about 0.1 to 0.15 wt. %.

A narrowly stated composition according to this invention would contain about 6.4 or 6.9 to 8.5 or 9 wt. % Zn, about 1.2 or 1.3 to 1.65 or 1.68 wt. % Mg, about 1.2 or 1.3 to 1.8 or 1.85 wt. % Cu and about 0.05 to 0.15 wt. % Zr. Optionally, the latter composition may include up to 0.03, 0.04 or 0.06 wt. % Ti, up to about 0.4 wt. % Sc, and up to about 0.008 wt. % Ca.

Still more narrowly defined, the presently preferred compositional ranges of this invention contain from about 6.9 or 7 to about 8.5 wt. % Zn, from about 1.3 or 1.4 to about 1.6 or 1.7 wt. % Mg, from about 1.4 to about 1.9 wt. % Cu and from about 0.08 to 0.15 or 0.16 wt. % Zr. The % Mg does not exceed (% Cu+0.3), preferably not exceeding (% Cu+0.2), or better yet (% Cu+0.1). For the foregoing preferred embodiments, Fe and Si contents are kept rather low, at or below about 0.04 or 0.05 wt. % each. A preferred composition contains: about 7 to 8 wt. % Zn, about 1.3 to 1.68 wt. % Mg and about 1.4 to 1.8 wt. % Cu, with even more preferably wt. % Mg≦wt. % Cu, or better yet Mg<Cu. It is also preferred that the magnesium and copper ranges of this invention, when combined, not exceed about 3.5 wt. % total, with wt. % Mg+wt. % Cu≦about 3.3 on a more preferred basis.

The alloys of the present invention can be prepared by more or less conventional practices including melting and direct chill (DC) casting into ingot form. Conventional grain refiners such as those containing titanium and boron, or titanium and carbon, may also be used as is well-known in the art. After conventional scalping (if needed) and homogenization, these ingots are further processed by, for example, hot rolling into plate or extrusion or forging into special shaped sections. Generally, the thick sections are on the order of greater than 2 inches and, more typically, on the order of 4, 6, 8 or up to 12 inches or more in cross section. In the case of plate about 4 to 8 inches thick, the aforementioned plate is solution heat treated (SHT) and quenched, then mechanically stress relieved such as by stretching and/or compression up to about 8%, for example, from about 1 to 3%. A desired structural shape is then machined from these heat treated plate sections, more often generally after artificial aging, to form the desired shape for the part, such as, for example, an integral wing spar. Similar SHT, quench, often stress relief operations and artificial aging are also followed in the manufacture of thick sections made by extrusion and/or forged processing steps.

Good combinations of properties are desired in all thicknesses, but they are particularly useful in thickness ranges where, conventionally, as the thickness increases, quench sensitivity of the product also increases. Hence, the alloy of the present invention finds particular utility in thick gauges of, for example, greater than 2 to 3 inches in thickness up to 12 inches or more.

PREFERRED EMBODIMENTS

Figure 1:
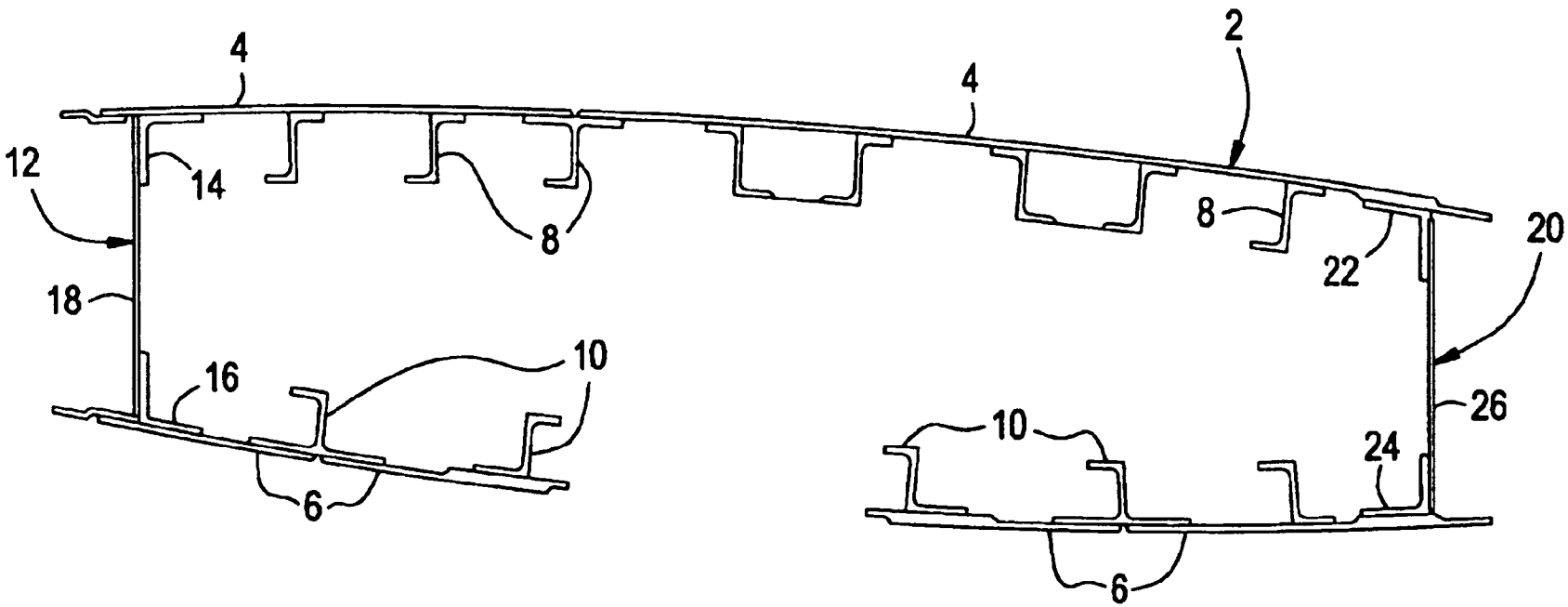
FIG. 1 is a transverse cross-sectional view of a typical wing box construction of an aircraft including front and rear spars of conventional three-piece built-up design.

Mechanical properties of importance for the thick plate, extrusion or forging for aircraft structural products, as well as other non-aircraft structural applications, include strength, both in compression as for the upper wing skin and in tension for the lower wing skin. Also important are fracture toughness, both plane-strain and plane-stress, and corrosion resistance performance such as exfoliation and stress corrosion cracking resistance, and fatigue, both smooth and open-hole fatigue life (S/N) and fatigue crack growth (FCG) resistance.

As described above, integral wing spars, ribs, webs, and wing skin panels with integral stringers, can be machined from thick plates or other extruded or forged product forms which have been solution heat treated, quenched, mechanically stress relieved (as needed) and artificially aged. It is not always feasible to solution heat treat and rapidly quench the finished structural component itself because the rapid cooling from quenching may induce residual stress and cause dimensional distortions. Such quench-induced residual stresses can also cause stress corrosion cracking. Likewise, dimensional distortions due to rapid quenching may necessitate re-working to straighten parts that have become so distorted as to render standard assembly impracticably difficult. Other representative aerospace parts/products that can be made from this invention include, but are not limited to: large frames and fuselage bulkheads for commercial jet airliners, hog out plates for the upper and lower wing skins of smaller, regional jets, landing gear and floor beams for various jet aircraft, even the bulkheads, fuselage components and wing skins of fighter plane models. In addition, the alloy of this invention can be made into miscellaneous small forged parts and other hogged out structures of aircraft that are currently made from alloy 7050 or 7010 aluminum.

While it is easier to obtain better mechanical properties in thin cross sections (because the faster cooling of such parts prevents unwanted precipitation of alloying elements), rapid quenching can cause excessive quench distortion. To the extent practical, such parts may be mechanically straightened and/or flattened while residual stress relief practices are performed thereon after which these parts are artificially aged.

As indicated above, in solution heat treating and quenching thick sections, the quench sensitivity of the aluminum alloy is of great concern. After solution heat treating, it is desirable to quickly cool the material for retaining various alloying elements in solid solution rather than allowing them to precipitate out of solution in coarse form as otherwise occurs via slow cooling. The latter occurrence produces coarse precipitates and results in a decline in mechanical properties. In products with thick cross sections, i.e. over 2 inches thick at its greatest point, and more particularly, about 4 to 8 inches thick or more, the quenching medium acting on exterior surfaces of such workpieces (either plate, forging or extrusion) cannot efficiently extract heat from the interior including the center (or mid-plane (T/2)) or quarter-plane (T/4) regions of that material. This is due to the physical distance to the surface and the fact that heat extracts through the metal by a distance dependent conduction. In thin product cross sections, quench rates at the mid-plane are naturally higher than quench rates for a thicker product cross sections. Hence, an alloy's overall quench sensitivity property is often not as important in thinner gauges as it is for thicker gauged parts, at least from the standpoint of strength and toughness.

The present invention is primarily focused on increasing the strength-toughness properties in a 7XXX series aluminum alloy in thicker gauges, i.e. greater than about 1.5 inches. The low quench sensitivity of the invention alloy is of extreme importance. In thicker gauges, the less quench sensitivity the better with respect to that material's ability to retain alloying elements in solid solution (thus avoiding the formation of adverse precipitates, coarse and others, upon slow cooling from SHT temperatures) particularly in the more slowly cooling mid- and quarter-plane regions of said thick workpiece. This invention achieves its desired goal of lowering quench sensitivity by providing a carefully controlled alloy composition which permits quenching thicker gauges while still achieving superior combinations of strength-toughness and corrosion resistance performance.

To illustrate the invention, twenty-eight, 11-inch diameter ingots were direct chill (or DC) cast, homogenized and extruded into 1.25×4 inch wide rectangular bars. Those bars were all solution heat treated before being quenched at different rates to simulate cooling conditions for thin sections as well as for approximating conditions for the mid-plane of 6- and 8-inch thick workpiece sections. These rectangular test bars were then cold stretched by about 1.5% for residual stress relief. The compositions of alloys studied are set forth in Table 2 below, in which Zn contents ranged from about 6.0 wt. % to slightly in excess of 11.0 wt. %. For these same test specimens, Cu and Mg contents were each varied between about 1.5 and 2.3 wt. %.

TABLE 2

| SAMPLE | Invention Alloy | Composition (wt. %) | | |
|---|---|---|---|---|
| No. | Y/N | Cu | Mg | Zn |
| 1 | Y | 1.57 | 1.55 | 6.01 |
| 2 | N | 1.64 | 2.29 | 5.99 |
| 3 | N | 2.45 | 1.53 | 5.86 |
| 4 | N | 2.43 | 2.26 | 6.04 |
| 5 | N | 1.95 | 1.94 | 6.79 |
| 6 | Y | 1.57 | 1.51 | 7.56 |
| 7 | N | 1.59 | 2.30 | 7.70 |
| 8 | N | 2.45 | 1.54 | 7.71 |
| 9 | N | 2.46 | 2.31 | 7.70 |
| 10 | N | 2.05 | 1.92 | 8.17 |
| 11 | Y | 1.53 | 1.52 | 8.65 |
| 12 | N | 1.57 | 2.35 | 8.62 |
| 13 | N | 2.32 | 1.45 | 8.25 |
| 14 | N | 2.04 | 2.19 | 8.33 |

TABLE 2-continued

| SAMPLE No. | Invention Alloy Y/N | Composition (wt. %) Cu | Mg | Zn |
|---|---|---|---|---|
| 15 | N | 1.86 | 1.93 | 10.93 |
| 16 | N | 1.98 | 2.09 | 11.28 |
| 17 | N | 1.97 | 1.86 | 9.04 |
| 18 | Y | 1.48 | 1.50 | 9.42 |
| 19 | N | 1.75 | 2.29 | 9.89 |
| 20 | N | 2.48 | 1.52 | 9.60 |
| 21 | N | 2.19 | 2.19 | 9.74 |
| 22 | N | 1.68 | 1.55 | 11.38 |
| 23 | N | 1.65 | 2.28 | 11.04 |
| 24 | N | 2.38 | 1.53 | 11.08 |
| 25 | N | 2.22 | 1.97 | 9.04 |
| 26 | N | 1.79 | 2.00 | 10.17 |
| 27 | N | 2.23 | 2.28 | 6.62 |
| 28 | N | 2.48 | 1.98 | 8.31 |

For all alloys other than the controls: Target Si = 0.03, Fe = 0.05, Zr = 0.12, Ti = 0.025
For 7150 Control (Sample #27): Target Si = 0.05, Fe = 0.10, Zr = 0.12, Ti = 0.025
For 7055 Control (Sample #28): Target Si = 0.07, Fe = 0.11, Zr = 0.12, Ti = 0.025

Different quenching approaches were explored to obtain, at the mid-plane of a 1.25 inch thick extruded bar, a cooling rate simulating that at the mid-plane of a 6-inch thick plate spray quenched in 75° F. water as would be the case in full-scale production. A second set of data involved simulating, under identical circumstances, a bar cooling rate corresponding to that of an 8-inch thick plate.

The aforesaid quenching simulation involved modifying the heat transfer characteristics of quenching medium, as well as the part surface, by immersion quenching extruded bars via the simultaneous incorporation of three known quenching practices: (i) a defined warm water temperature quench; (ii) saturation of the water with $CO_2$ gas; and (iii) chemically treating the bars to render a bright etch surface finish to lower surface heat transfer.

For simulating the 6-inch thick plate cooling condition: the water temperature for immersion quenching was held at about 180° F.; and the solubility level of $CO_2$ in the water kept at about 0.20 LAN (a measure of dissolved $CO_2$ concentration, LAN=standard volume of $CO_2$/volume of water). Also, the sample surface was chemically treated to have a standard, bright etch finish.

For the 8-inch thick plate cooling simulation, the water temperature was raised to about 190° F. with a $CO_2$ solubility reading varying between 0.17 and 0.20 LAN. Like the 6 inch samples above, this thicker plate was chemically treated to have a standard bright etch surface finish.

Figure 2:
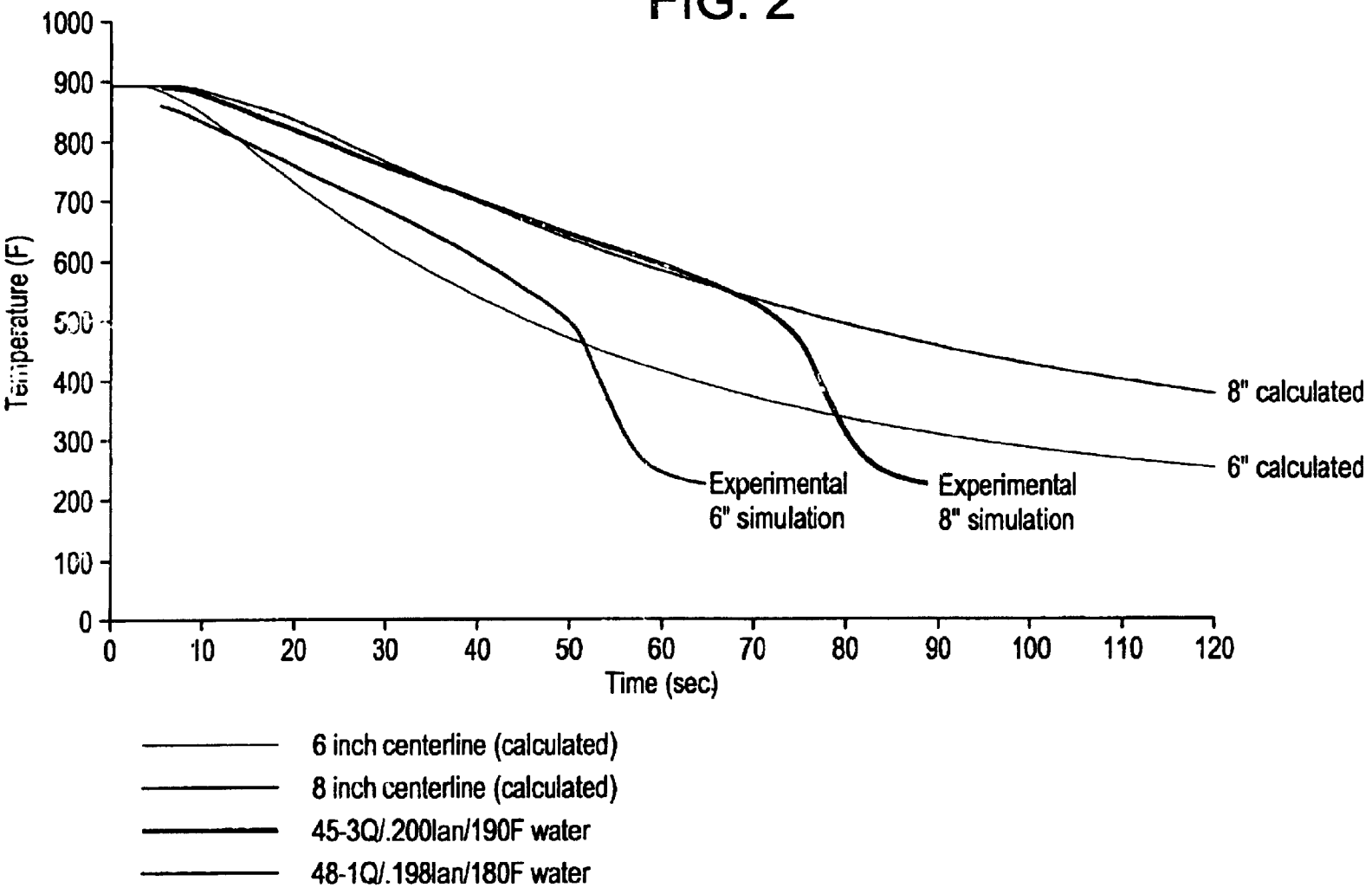
FIG. 2 is a graph showing two calculated cooling curves to approximate the mid-plane cooling rates for plant made, 6- and 8-inch thick plates under spray quenching, over which two experimental cooling curves, simulating the cooling rates of a 6-inch thick and an 8-inch thick plate, are superimposed.

The cooling rates were measured by thermocouples inserted into the mid-plane of each bar sample. For benchmark reference, the two calculated cooling curves to approximate the mid-plane cooling rates under spray quenching at plant-made 6- and 8-inch thick plates were plotted per accompanying FIG. 2. Superimposed on them were displayed two groups of plots, the lower group (in the temperature scale) representing simulated cooling rate curves mid-plane of a 6-inch thick plate; and the upper, simulated mid-plane for an 8-inch thick plate, These simulated cooling rates were very similar to those of plant production plates in the important temperature range above about 500° F., although the simulated cooling curves for experimental materials differed from those for plant plate below 500° F., which was not considered critical.

After solution heat treating and quenching, artificial aging behaviors were studied using multiple aging times to obtain acceptable electrical conductivity ("EC") and exfoliation corrosion resistance ("EXCO") readings. The first two-step aging practice for the invention alloy consisted of: a slow heat-up (for about 5 to 6 hours) to about 250° F., a 4 to 6 hour soak at about 250° F., followed by a second step aging at about 320° F. for varying times ranging from about 4 to 36 hours.

Tensile and compact tension plane-strain fracture toughness test data were then collected on samples given the different minimum aging times required to obtain a visual EXCO rating of EB or better (EA or pitting only) for acceptable exfoliation corrosion resistance performance, and an electrical conductivity EC minimum value of at or above about 36% IACS (International Annealed Copper Standard), the latter value being used to indicate degree of necessary over-aging and provide some indication of corrosion resistance performance enhancement as is known in the art. All tensile tests were performed according to the ASTM Specification E8, and all plane-strain fracture toughness per ASTM specification E399, said specifications being well known in the art.

Figure 3:
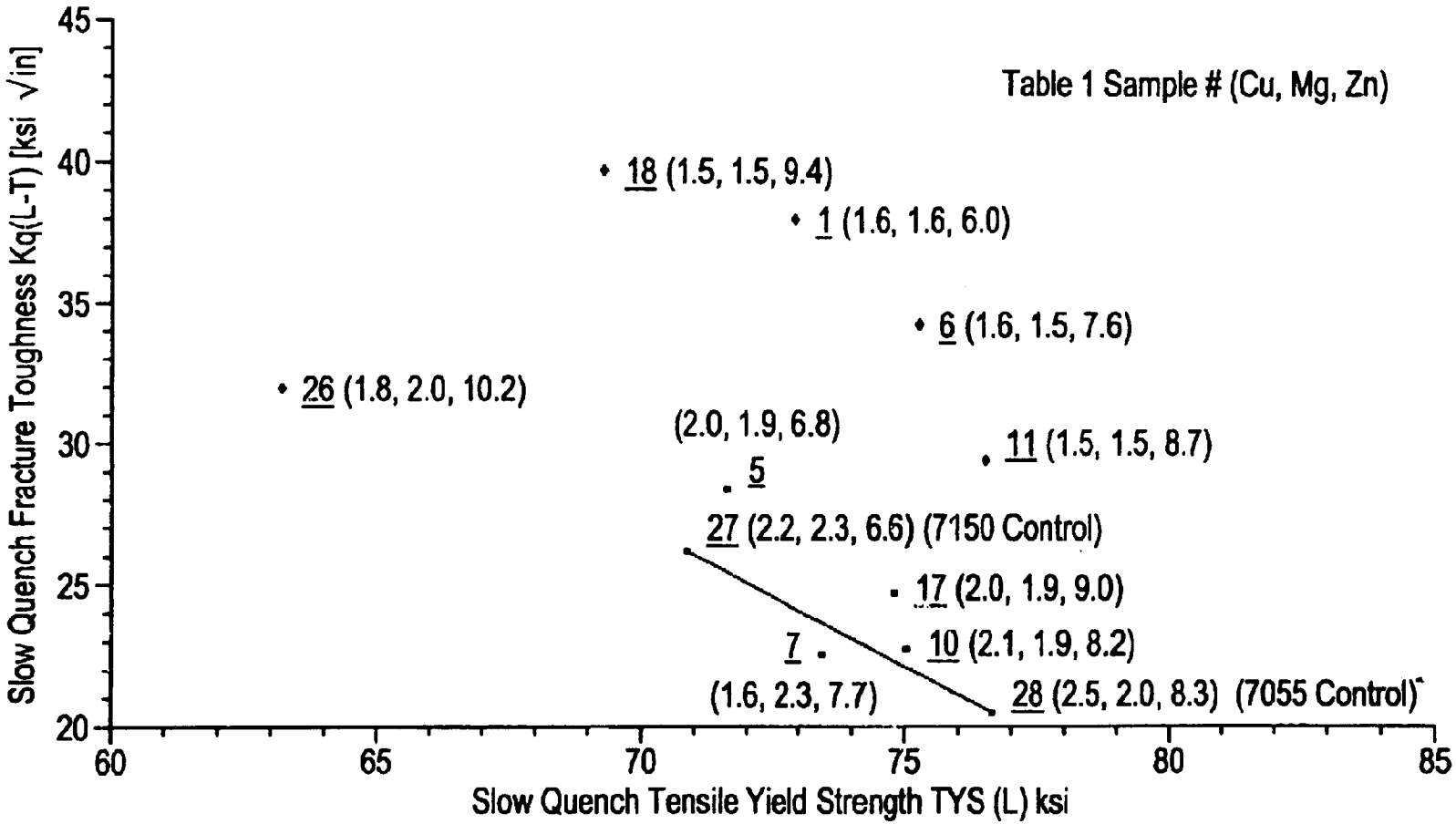
FIG. 3 is a graph showing longitudinal tensile yield strength TYS (L) versus longitudinal fracture toughness $K_q$ (L-T) relations for selected alloys of the present invention and other alloys including 7150 and 7055 type comparisons or "controls", all based on simulation of mid-plane (or "T/2") quench rates for a 6-inch thick plate, extrusion or forging.

FIG. 3 shows the plotted strength-toughness results from Table 2 alloy samples slowly quenched from their SHT temperatures for simulating a 6-inch thick product. One family of compositions noticeably stood out from the rest of those plotted, namely sample numbers 1, 6, 11 and 18 (in the upper portions of FIG. 3). All of those sample numbers-displayed very high fracture toughness combined with high strength properties. Surprisingly, all of those sample alloy compositions belonged to the low Cu and low Mg ends of our choice compositional ranges, namely, at around 1.5 wt. % Mg together with 1.5 wt. % Cu, while the Zn levels therefor varied from about 6.0 to 9.5 wt. %. Particular Zn levels for these improved alloys were measured at: 6 wt. % Zn for Sample #1, 7.6 wt. % Zn for Sample #6, 8.7 wt. % Zn for Sample #11 and 9.4 wt. % Zn for Sample #18.

Substantial improvements in strength and toughness can also be seen when the aforementioned alloy performances are compared against two "control" alloys 7150 aluminum (Sample # 27 above) and 7055 aluminum (Sample #28) both of which were processed in an identical manner (including temper). In FIG. 3, a drawn dotted line connects the latter two control alloy data points to show their "strength-toughness property trend" whereby higher strength is accompanied by lower toughness performance. Note how the FIG. 3 line for control alloys 7150 and 7055 extends considerably below the data points discussed for invention alloy Sample Nos. 1, 6, 11 and 18 above.

Also included in the FIG. 3 plots are results for alloys having about 1.9 wt. % Mg and 2.0 wt. % Cu with various Zn levels: 6.8 wt. % (For Sample #5), 8.2 wt. % (for Sample #10), 9.0 wt. % (for Sample #17) and 10.2 wt. % (for Sample #26). Such results once again graphically illustrate the drop in toughness observed for these alloys compared to 1.5 wt. % Mg and 1.5 wt. % Cu containing alloys at corresponding levels of total Zn. And while the thick gauge, strength-toughness properties for higher Mg and Cu alloy products were similar to or marginally better than those for the 7150 and 7055 controls (dotted trend line), such results clearly demonstrate a significant degradation in both strength and toughness properties that occurs with a moderate increase in Cu and Mg: (1) above the Cu and Mg levels of the present invention alloy, and (2) approaching the Cu/Mg levels of many current commercial alloys.

Figure 4:
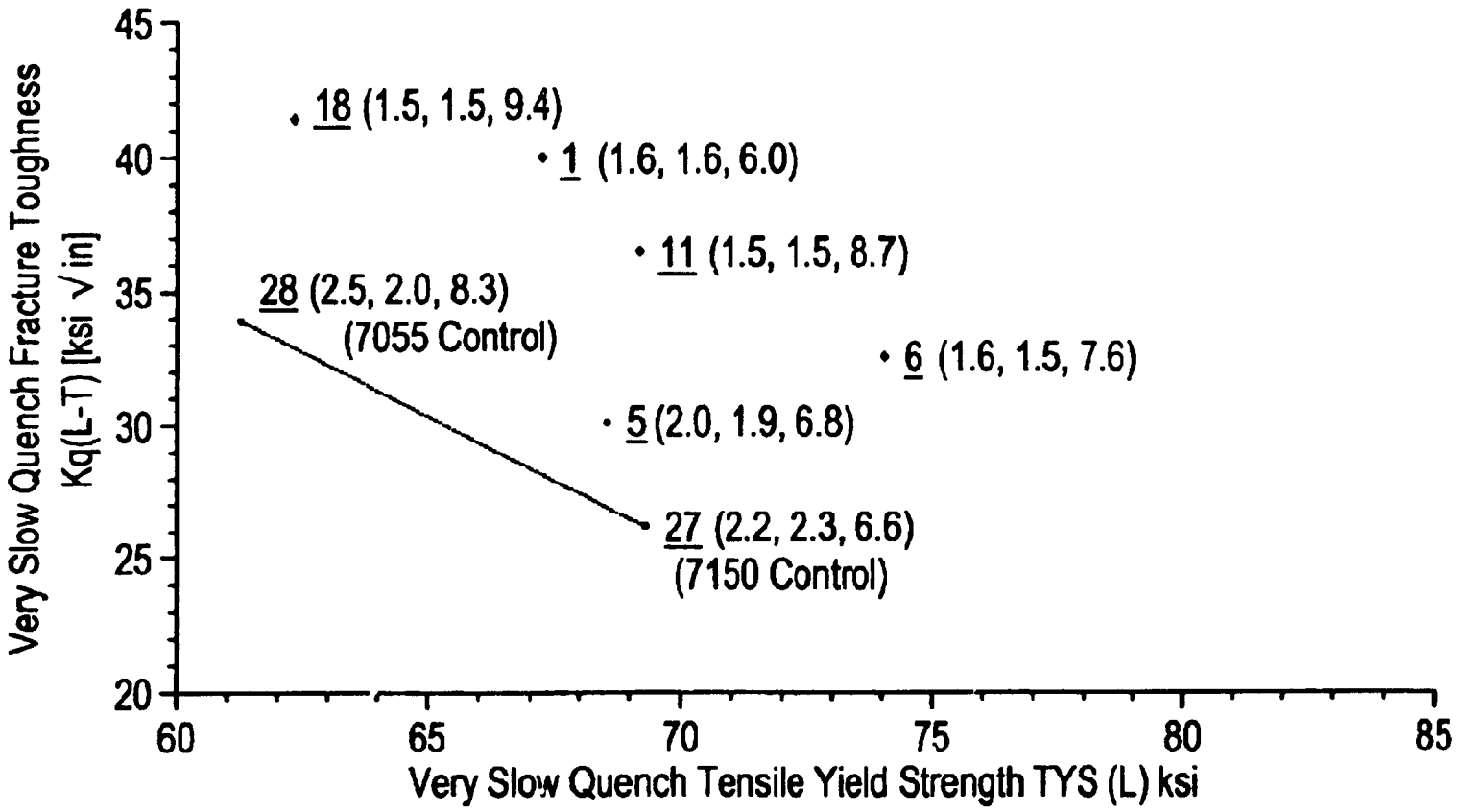
FIG. 4 is a graph similar to FIG. 3 showing longitudinal tensile yield strength TYS (L) versus fracture toughness $K_q$ (L-T) relations for selected alloys of the present invention and other alloys including 7150 and 7055 controls, all based on simulation of mid-plane quench rates for an 8-inch thick plate, extrusion or forging.

A similar set of results are graphically depicted in accompanying FIG. 4 for a quench condition even slower than that shown and described for above FIG. 3. The FIG. 4 conditions roughly approximate those for an 8-inch thick plate, mid-plane cooling condition. Similar conclusions as per FIG. 3 can be drawn for the data depicted in FIG. 4 for a still slower quench simulation performed to represent a still thicker plate product.

Thus, unlike past teachings, some of the highest strength-toughness properties were obtained at some of the leanest Cu and Mg levels used thus far for current commercial aerospace alloys. Concomitantly, the Zn levels at which these properties were most optimized correspond to levels much higher than those specified for 7050, 7010 or 7040 aluminum plate products.

Figure 5:
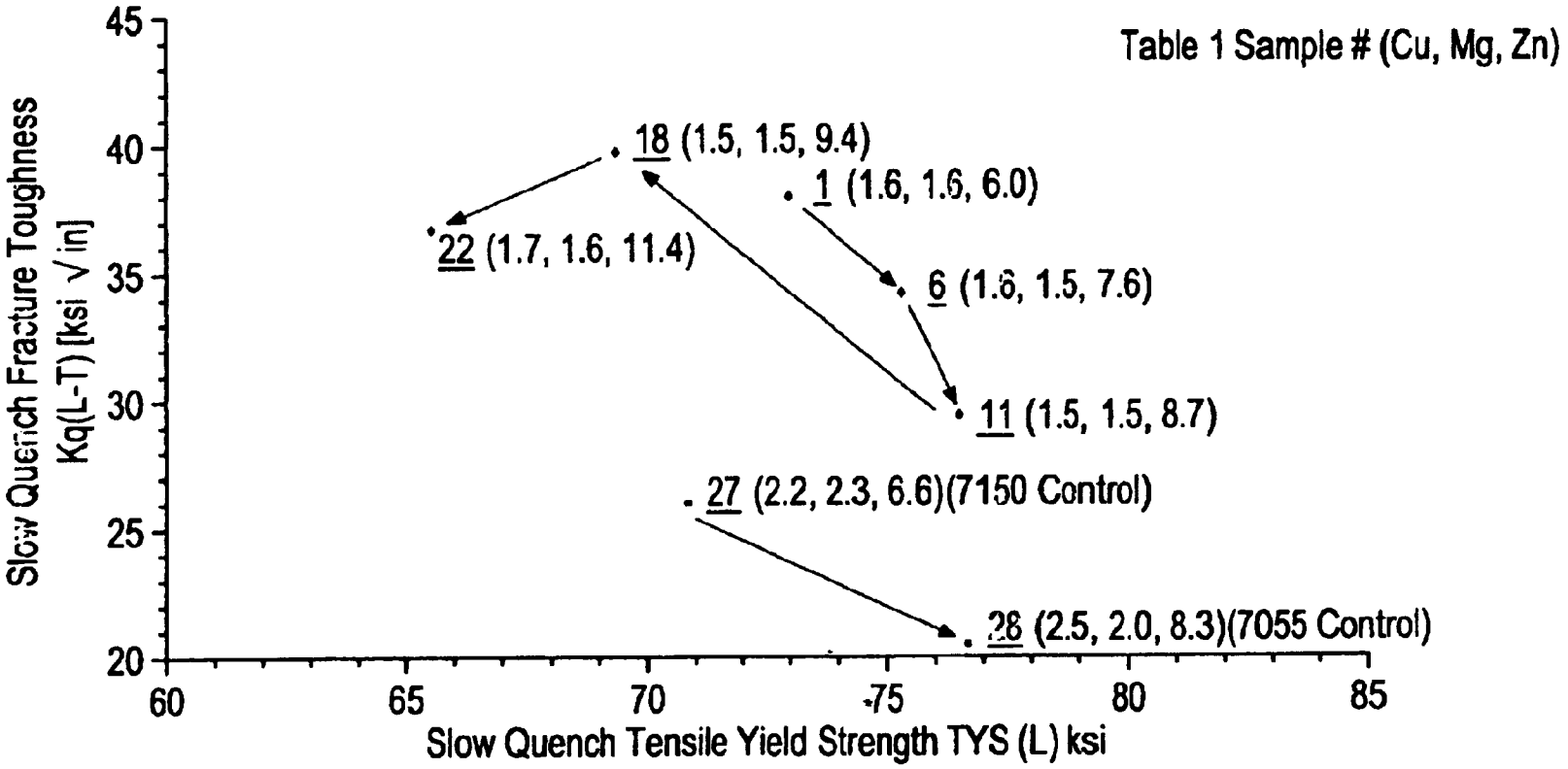
FIG. 5 is a graph showing the influence of Zn content on quench sensitivity as demonstrated by directional arrows for TYS changes in a 6-inch thick plate quench simulation.

It is believed that a good portion of the improvement in strength and toughness properties observed for thick sections of the invention alloy are due to the specific combination of alloy ingredients. For instance, the accompanying FIG. 5 TYS strength values increase gradually with increasing Zn content, from Sample #1 to Sample #6 to Sample #11 and are superior to the prior art "controls". Thus, unlike past teachings, higher Zn solutes do not necessarily increase quench sensitivity if the alloy is properly formulated as provided herein. On the contrary, the higher Zn levels of this invention have actually proven to be beneficial against the slow quench conditions of thick sectioned workpieces. At still higher Zn levels of 9.4 wt. %, however, the strength can drop. Hence, the TYS strength of Sample #18 (containing 9.42 wt. % Zn) drops below those for the other, lower Zn invention alloys in FIG. 5.

Figure 6:
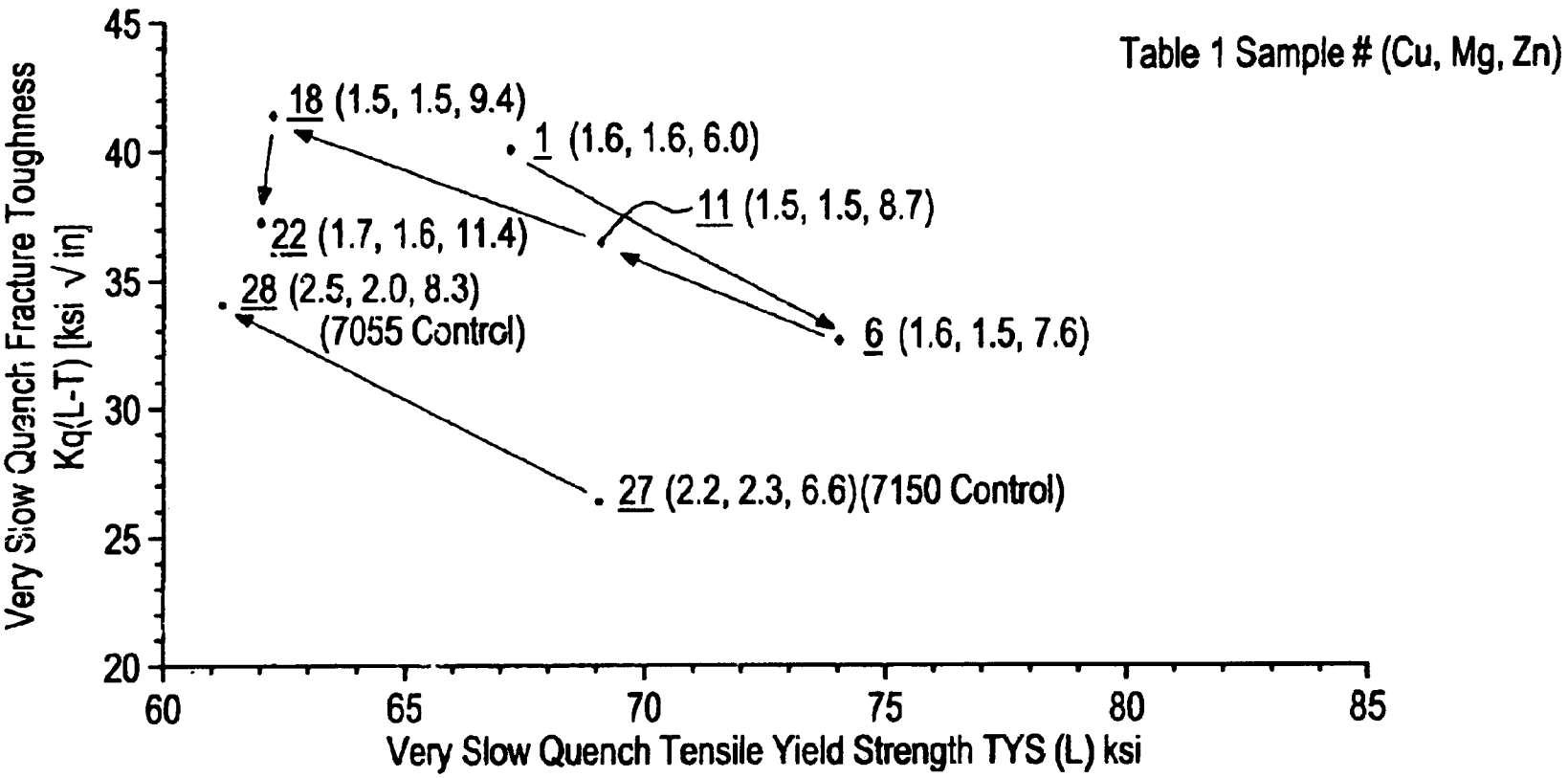
FIG. 6 is a graph showing the influence of Zn content on quench sensitivity as demonstrated by directional arrows for TYS changes in an 8-inch thick plate quench simulation.

In accompanying FIG. 6, still further, slower quench conditions for simulated 8-inch thicknesses are depicted. From that data, it can be seen that quench sensitivity can increase even at 8.7 wt. % Zn levels, as depicted by the TYS strength values for Sample #11 displaced below that for Sample #6's total Zn content of 7.6 wt. %. This high solute effect on quench sensitivity is also evidenced by the relative positions of control alloys 7150 (Sample #27) and 7055 (Sample #28) on the TYS strength axes of the accompanying figures. Therein, 7055 was stronger than 7150 under slow quench (FIG. 5), but the relative scale was reversed under still slower quench conditions (per FIG. 6).

Also noteworthy is the performance of Sample #7 above, which according to Table 2 contained 1.59 wt. % Cu, 2.30 wt. % Mg and 7.70 wt. % Zn, (so that its Mg content exceeded Cu content). From FIG. 3, that Sample exhibited high TYS strengths of about 73 ksi but with a relatively low fracture toughness, $K_Q$(L-T), of about 23 ksi√in. By comparison, Sample #6, which contained 7.56% Zn, 1.57% Cu and 1.51% Mg (with Mg<Cu) exhibited a FIG. 3 TYS strength greater than 75 ksi and a higher fracture toughness of about 34 ksi√in (actually a 48% increase in toughness). This comparative data shows the importance of: (1) maintaining Mg content at or below about 1.68 or 1.7 wt. %, as well as (2) keeping said Mg content less than or equal to the Cu content+0.3 wt. %, and more preferably below the Cu content, or at a minimum, not above the Cu content of the invention alloy.

It is desirable to achieve optimum and/or balanced fracture toughness ($K_Q$) and strength (TYS) properties in the alloys of this invention. As can be best seen and appreciated by comparing the compositions of Table 2 with their corresponding fracture toughness and strength values plotted in FIG. 3, those alloy samples falling within the compositions of this invention achieve such a balance of properties. Particularly, those Sample Nos. 1, 6, 11 and 18 either possess a fracture toughness value ($K_Q$) (L-T) in excess of about 34 ksi√in with a TYS greater than about 69 ksi; or they possess a fracture toughness value greater than about 29 ksi√in combined with a higher TYS of about 75 ksi or greater.

The upper limit of Zn content appears to be important in achieving the proper balance between toughness and strength properties. Those samples which exceeded about 11.0 wt. %, such as Sample Nos. 24 (11.08 wt. % Zn) and 22 (11.38 wt. % Zn), failed to achieve the minimum combined strength and fracture toughness levels set forth above for alloys of the invention.

The preferred alloy compositions herein thus provide high damage tolerance in thick aerospace structures resulting from its enhanced, combined fracture toughness and yield strength properties. With respect to some of the property values reported herein, one should note that $K_Q$ values are the result of plane strain fracture toughness tests that do not conform to the current validity criteria of ASTM Standard E399. In the current tests that yield $K_Q$ values, the validity criteria that were not precisely followed were: (1) $P_{MAX}/P_Q<1.1$ primarily, and (2) B (thickness)$>2.5(K_Q/\Phi_{YS})^2$ occasionally, where $K_Q$, $\sigma_{YS}$, $P_{MAX}$, and $P_Q$ are as defined in ASTM Standard E399-90. These differences are a consequence of the high fracture toughnesses observed with the invention alloy. To obtain valid plane-strain $K_{Ic}$ results, a thicker and wider specimen would have been required than is facilitated with an extruded bar (1.25 inch thick×4 inch wide). A valid $K_{Ic}$ is generally considered a material property relatively independent of specimen size and geometry. $K_Q$, on the other hand, may not be a true material property in the strictest academic sense because it can vary with specimen size and geometry. Typical $K_Q$ values from specimens smaller than needed are conservative with respect to $K_{Ic}$, however. In other words, reported fracture toughness ($K_Q$) values are generally lower than standard $K_{Ic}$ values obtained when the sample size related, validity criteria of ASTM Standard E399-90 are satisfied. The $K_Q$ values were obtained herein using compact tension test specimens per ASTM E399 having a thickness B of 1.25 inch and width that varied between 2.5 to 3.0 inches for different specimens. Those specimens were fatigue pre-cracked to a crack length A of 1.2 to 1.5 inch (A/W=0.45 to 0.5). The tests on plant trial material, discussed below, which did satisfy the validity criterion of ASTM Standard E399 for $K_{Ic}$ were conducted using compact tension specimens with a thickness, B=2.0 inch, and width, W=4.0 inch. Those specimens were fatigue pre-cracked to a crack length of 2.0 inch (A/W=0.5). All cases of comparative data between varying alloy compositions were made using results from specimens of the same size and under similar test conditions.

EXAMPLE 1

Plant Trial—Plate

Figure 7:
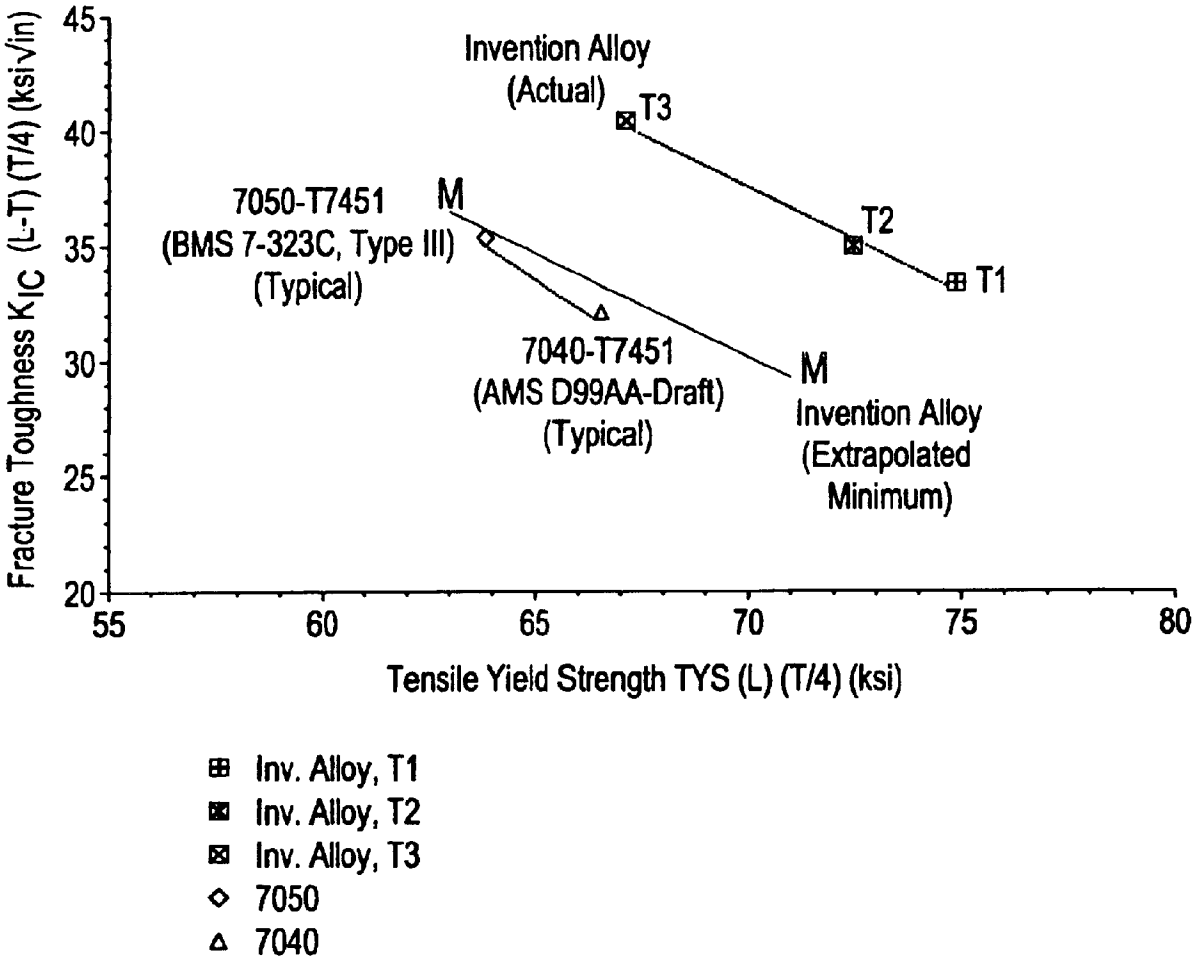
FIG. 7 is a graph showing cross plots of TYS (L) versus plane-strain fracture toughness $K_{Ic}$ (L-T) values at quarter plane (T/4) of a full-scale production 6-inch thick plate of the invention alloy with the currently extrapolated minimum value line (M—M) drawn thereon for comparing with literature reported values for 7050 and 7040 aluminum.

A plant trial was conducted using a standard, full-size ingot cast with the following invention alloy composition: 7.35 wt. % Zn, 1.46 wt. % Mg, 1.64 wt. % Cu, 0.04 wt. % Fe, 0.02 wt. % Si and 0.11 wt. % Zr. That ingot was scalped, homogenized at 885° to 890° F. for 24 hours, and hot rolled to 6-inch thick plate. The rolled plate was then solution heat treated at 885° to 890° F. for 140 minutes, spray quenched to ambient temperature, and cold stretched from about 1.5 to 3% for residual stress relief. Sections from that plate were subjected to a two-step aging practice that consisting of a 6-hour/250° F. first step aging followed by a second step age at 320° F. for 6, 8 and 11 hours, respectively designated as times T1, T2 and T3 in the table that follows. Results from the tensile, fracture toughness, alternate immersion SCC, EXCO and electrical conductivity tests are presented in Table 3 below. FIG. 7 shows the cross plot of L-T plane-strain fracture toughness ($K_{Ic}$) versus longitudinal tensile yield strength TYS (L), both samples having been taken from the quarter-plane (T/4) location of the plate. A linear strength-toughness correlation trend (Line T3-T2-T1) was drawn to define through the data for these representative, second stage aging times. A preferred minimum performance line (M—M) was also drawn. Also included in FIG. 7 are the typical properties from 6-inch thick 7050-T7451 plates produced by industry specification BMS 7-323C and the 7040-T7451 typical values for 6-inch thick plate per AMS D99AA draft specification (ref. *Preliminary Materials Properties Handbook*), both specifications being known in the art. From this preliminary data on two step aged plate, the alloy compositions of this invention clearly display a much superior strength-toughness combination compared to either 7050 or 7040 alloy plate. In comparison to 7050-T7451 plate, for example, the two step aged versions of this invention achieved a TYS increase of about 11% (72 ksi versus 64 ksi), at the equivalent $K_{Ic}$ of 35 ksi/in. Stated differently, significant increases in $K_{Ic}$ values were obtained with the present invention at equivalent TYS levels. For example, the two step aged versions of this plate product achieved a 28% $K_{Ic}$ (L-T) toughness increase (32.3 ksi/in versus 41 ksi/in) as compared to its 7040-T7451 equivalent at the same TYS (L) level of 66.6 ksi.

TABLE 3

Properties of Plant Processed, 6-inch Thick Plate Samples of the Invention Alloy

| Aging Time at 320° F. (Hrs.) | L-UTS (T/4) (ksi) | L-TYS (T/4) (ksi) | EL (T/4) (%) | L-CYS (T/4) (ksi) | L-T $K_{IC}$ (T/4) (ksi$\sqrt{in}$) | EXCO (T/4) | EC (T/4) (% IACS) | SCC Stress (ASTM G44) (20d-Pass) (T/2) (ksi) |
|---|---|---|---|---|---|---|---|---|
| 6 (T1) | 77.1 | 74.9 | 6.8 | 73.2 | 33.6 | EB | 40.5 | 35 |
| 8 (T2) | 75.6 | 72.5 | 7.3 | 71.0 | 35.2 | EB | 41.3 | 40 |
| 11 (T3) | 71.9 | 67.2 | 8.6 | 65.6 | 40.5 | EA | 42.7 | 45 |

EXAMPLE 2

Plant Trial—Forging

A die forged evaluation of the invention alloy was performed in a plant-trial using two full-size production sheet/plate ingots, designated COMP1 and COMP2, as follows:

COMP 1: 7.35 wt. % Zn, 1.46 wt. % Mg, 1.64 wt. % Cu, 0.11 wt. % Zr, 0.038 wt. % Fe, 0.022 wt. % Si, 0.02 wt. % Ti;

COMP 2: 7.39 wt. % Zn, 1.48 wt. % Mg, 1.91 wt. % Cu, 0.11 wt. % Zr, 0.036 wt. % Fe, 0.024 wt. % Si, 0.02 wt. % Ti.

Figure 8:
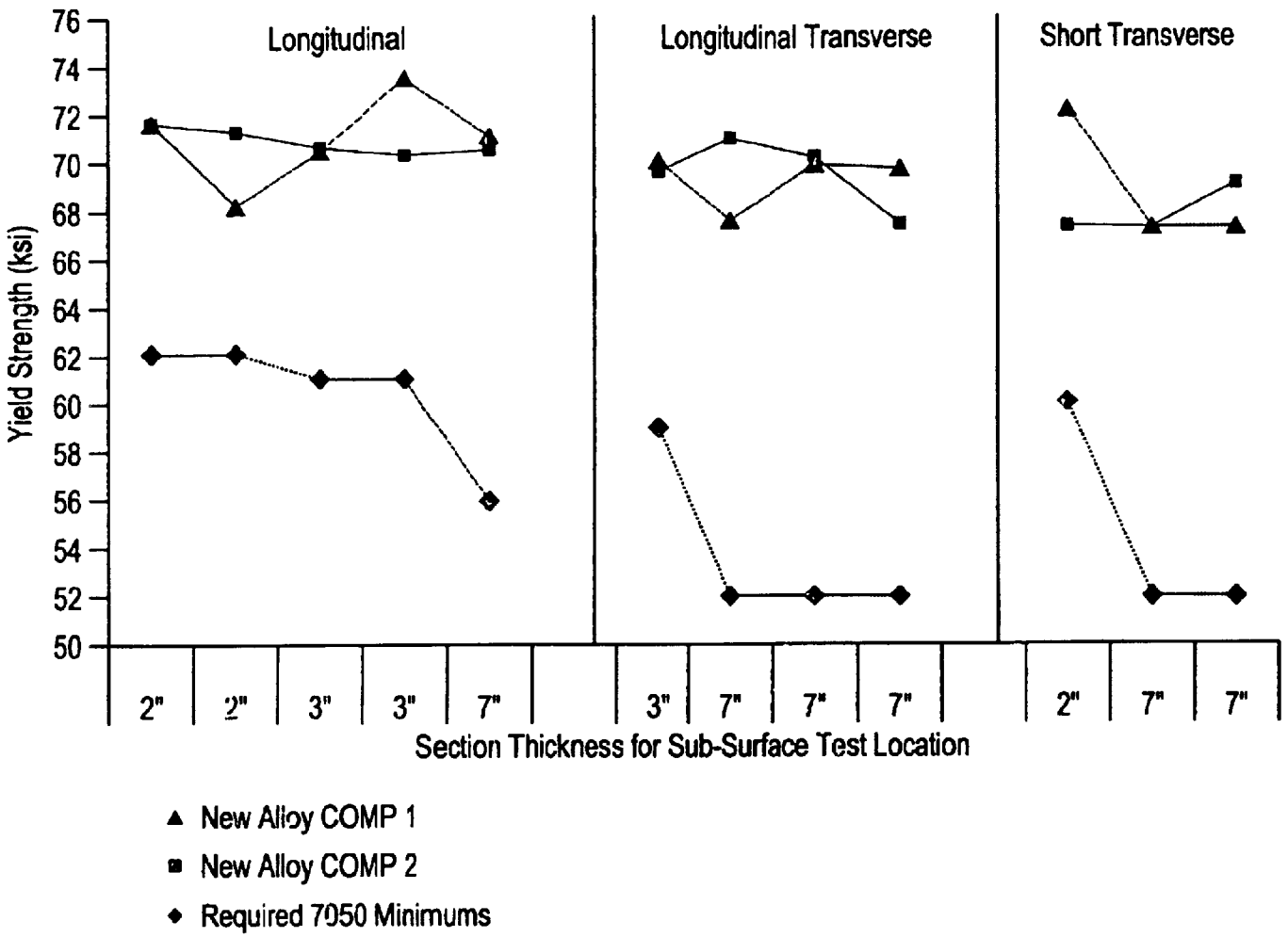
FIG. 8 is a graph showing the influence of section thickness on TYS values, as an index of quench sensitivity property, from a full-scale production, die-forging study comparing alloys of the invention versus 7050 aluminum.

A standard 7050 ingot was also run as a control. All of the aforesaid ingots were homogenized at 885° F. for 24 hours and sawed to billets for forging. A closed die, forged part was produced for evaluating properties at three different thicknesses, 2 inch, 3 inch and 7 inch. The fabrication steps conducted on these metals included: two pre-forming operations utilizing hand forging; followed by a blocker die operation and a final finish die operation using a 35,000 ton press. The forging temperatures employed therefor were between about 725–750° F. All the forged pieces were then solution heat treated at 880° to 890° F. for 6 hours, quenched and cold worked 1 to 5% for residual stress relief. The parts were next given a T74 type aging treatment for enhancing SCC performance. The aging treatment consisted of 225° F. for 8 hours, followed by 250° F. for 8 hours, then 350° F. for 8 hours. Results from the tensile tests performed in longitudinal, long-transverse and short-transverse directions are presented in accompanying FIG. 8. In all three orientations, the tensile yield strength (TYS) values for the invention alloy remained virtually unchanged for thicknesses ranging from 2 to 7 inches. In contrast, the specification for 7050 allows a drop in TYS values as thickness increased from 2 to 3 to 7 inches consistent with the known performance of 7050 alloy. Thus, FIG. 8 results clearly demonstrate this invention's advantage of low quench sensitivity, or restated, the ability of forgings made from this alloy to exhibit an insensitivity to strength changes over a large thickness range in contrast to the comparative strength property dropoff observed with thicker sections of prior art 7050 alloy forgings.

The present invention clearly runs counter to conventional 7XXX series alloy design philosophies which indicate that higher Mg contents are desirable for high strength. While that may still be true for thin sections of 7XXX aluminum, it is not the case for thicker product forms because higher Mg actually increases quench sensitivity and reduces the strength of thick sections.

Although the primary focus of this invention was on thick cross sectioned product quenched as rapidly as practical, those skilled in the art will recognize and appreciate that another application hereof would be to take advantage of the invention's low quench sensitivity and use an intentionally slow quench rate on thin sectioned parts to reduce the quench-induced residual stresses therein, and the amount/degree of distortion brought on by rapid quenching but without excessively sacrificing strength or toughness.

Another potential application arising from the lower quench sensitivities observed with this invention alloy is for products having both thick and thin sections such as die forgings and certain extrusions. Such products should suffer less from yield strength differences between thick and thin cross sectioned areas. That, in turn, should reduce the chances of bowing or distortion after stretching.

Generally, for any given 7XXX series alloy, as further artificial aging is progressively applied to a peak strength, T6-type tempered product (i.e. "overaging"), the strength of that product has been known to progressively and systematically decrease while its fracture toughness and corrosion resistance progressively and systematically increase. Hence, today's part designers have learned to select a specific temper condition with a compromise combination of strength, fracture toughness and corrosion resistance for a specific application. Indeed, such is the case for the alloy of the invention, as demonstrated in the cross plot of L-T plane strain fracture toughness $K_{Ic}$ and L tensile yield strength, in FIG. 7, both measured at quarter-plane (T/4) in the longitudinal direction for 6-inch thick plate product. FIG. 7 illustrates how the alloy of this invention provides a combination of: about 75 ksi yield strength with about 33 ksi√in fracture toughness, at the T1 aging time from Table 3; or about 72 ksi yield strength with about 35 ksi√in fracture toughness, with Table 3—aging time T2; or about 67 ksi yield strength and about 40 ksi√in fracture toughness, with Table 3—aging time T3.

It is further understood by those skilled in the art that, within limits, for a specific 7XXX series alloy, the strength-fracture toughness trend line can be interpolated and, to some extent, extrapolated to combinations of strength and fracture toughness beyond the three examples of invention alloy given above and plotted at FIG. 7. The desired combination of multiple properties can then be accomplished by selecting the appropriate artificial aging treatment therefor.

While the invention has been described largely with respect to aerospace structural applications, it is to be understood that its end use applications are not necessarily limited to same. On the contrary, the invention alloy and its preferred three stage aging practice herein are believed to have many other, non-aerospace related end use applications as relatively thick cast, rolled plate, extruded or forged product forms, especially in applications that would require relatively high strengths in a slowly quenched condition from SHT temperatures. An example of one such application is mold plate, which must be extensively machined into molds of various shapes for the shaping and/or contouring processes of numerous other manufacturing processes. For such applications, desired material characteristics are both high strength and low machining distortion. When using 7XXX alloys as mold plates, a slow quench after solution heat treatment would be necessary to impart a low residual stress, which might otherwise cause machining distortions. Slow quenching also results in lowered strength and other properties for existing 7XXX series alloys due to their higher quench sensitivity. It is the unique very low quench sensitivity for this invention alloy that permits a slow quench following SHT while still retaining relatively high strength capabilities that makes this alloy an attractive choice for such non-aerospace, non-structural applications as thick mold plate. For this particular application, though, it is not necessary to perform the preferred 3 step aging method described hereinbelow. Even a single step, or standard 2 step, aging practice should suffice. The mold plate can even be a cast plate product.

The instant invention substantially overcomes the problems encountered in the prior art by providing a family of 7000 Series aluminum alloy products which exhibits significantly reduced quench sensitivity thus providing significantly higher strength and fracture toughness levels than heretofore possible in thick gauge aerospace parts or parts machined from thick products. The aging methods described herein then enhance the corrosion resistance performance of such new alloys. Tensile yield strength (TYS) and electrical conductivity EC measurements (as a % IACS) were taken on representative samples of several new 7XXX alloy compositions and comparative aging processes practiced on the present invention. The aforesaid EC measurements are believed to correlate with actual corrosion resistance performance, such that the higher the EC value measured, the more corrosion resistant that alloy should be, As an illustration, commercial 7050 alloy is produced in three increasingly corrosion resistant tempers: T76 (with a typical SCC minimum performance, or "guarantee", of about 25 ksi and typical EC of 39.5% IACS); T74 (with a typical SCC guarantee of about 35 ksi and 40.5% IACS); and T73 (with it typical SCC guarantee of about 45 ksi and 41.5% IACS).

In aerospace, marine or other structural applications, it is quite customary for a structural and materials engineer to select materials for a particular component based on the weakest link failure mode. For example, because the upper wing alloy of an aircraft is predominantly subjected to compressive stresses, it has relatively lower requirements for SCC resistance involving tensile stresses. As such, upper wing skin alloys and tempers are usually selected for higher strength albeit with relatively low short-transverse SCC resistance. Within that same aerospace wing box, the spar members are subjected to tensile stresses. Although the structural engineer would desire higher strengths for this application in the interest of component weight reduction, the weakest link is the requirement of high SCC resistance for those component parts. Today's spar parts are thus traditionally manufactured from a more corrosion resistant, but lower strength alloy temper such as T74. Based on the observed EC increase at the same strength, and the Al SCC test results described above, the preferred, new 3 stage aging methods of this invention can offer these structural/materials engineers and aerospace part designers a method of providing the strength levels of 7050/7010/7040-T76 products with near T74 corrosion resistance levels. Alternatively, this invention can offer the corrosion resistance of a T76 tempered material in combination with significantly higher strength levels.

EXAMPLES

Three representative compositions of the new 7xxx alloy family were cast to target as large, commercial scale ingots with the following compositions:

TABLE 4

| Alloy | wt % Zn | wt % Cu | wt % Mg | wt % Fe | wt % Si | wt % Zr | wt % Ti |
|---|---|---|---|---|---|---|---|
| A | 7.3 | 1.6 | 1.5 | 0.04 | 0.02 | 0.11 | 0.02 |
| B | 6.7 | 1.9 | 1.5 | 0.05 | 0.02 | 0.11 | 0.02 |
| C | 7.4 | 1.9 | 1.5 | 0.04 | 0.02 | 0.11 | 0.02 |

Those cast ingot materials, of course after working, i.e. rolling to 6 inch finish gauge plate, solution heat treating, etc., were subjected to the comparative aging practice variations set forth in Table 5 below. Actually, two different first stages were compared in this 3 stage evaluation, one having a single exposure at 250° F. with the other broken into two sub-stages: 4 hours @ 225° F., followed by a second sub-stage of 6 hours @ 250° F. This two sub-stage procedure is referred to herein as first a first stage treatment, i.e., prior to the second stage treatment at about 310° F. In any event, no noticeable difference in properties was observed between these two "types" of first stages, the lone treatment at 250° F. versus the split treatments at both 225 and 250° F. Hence, referring to any stage herein embraces such variants.

TABLE 5

| | First Step/Time | Second Step/Time | Third Step/Time |
|---|---|---|---|
| Two Step Aging | 250° F./6 hrs. | 310° F./~5 to 15 hrs. | — |
| Three Step Aging | 250° F./6 hrs. | 310° F./~5 to ~15 hrs. | 250° F./24 hrs. |
| | 225° F./4 hrs. + 250° F./6 hrs. | 310° F./~5 to ~15 hrs. | 250° F./24 hrs. |

Specimens from each six inch thick plate were then tested, with the averages for the two-and three-step aged properties being measured as follows:

TABLE 6

Average TYS & EC Properties

| Alloy | Tensile Yield (T/4) ksi | 2-step Age EC, % IACS | 3-step Age EC, % IACS |
|---|---|---|---|
| A | 74.4 | 38.5 | 40.0 |
| B | 74.6 | 38.5 | 39.8 |
| C | 75.3 | 38.5 | 39.7 |

Figure 9:
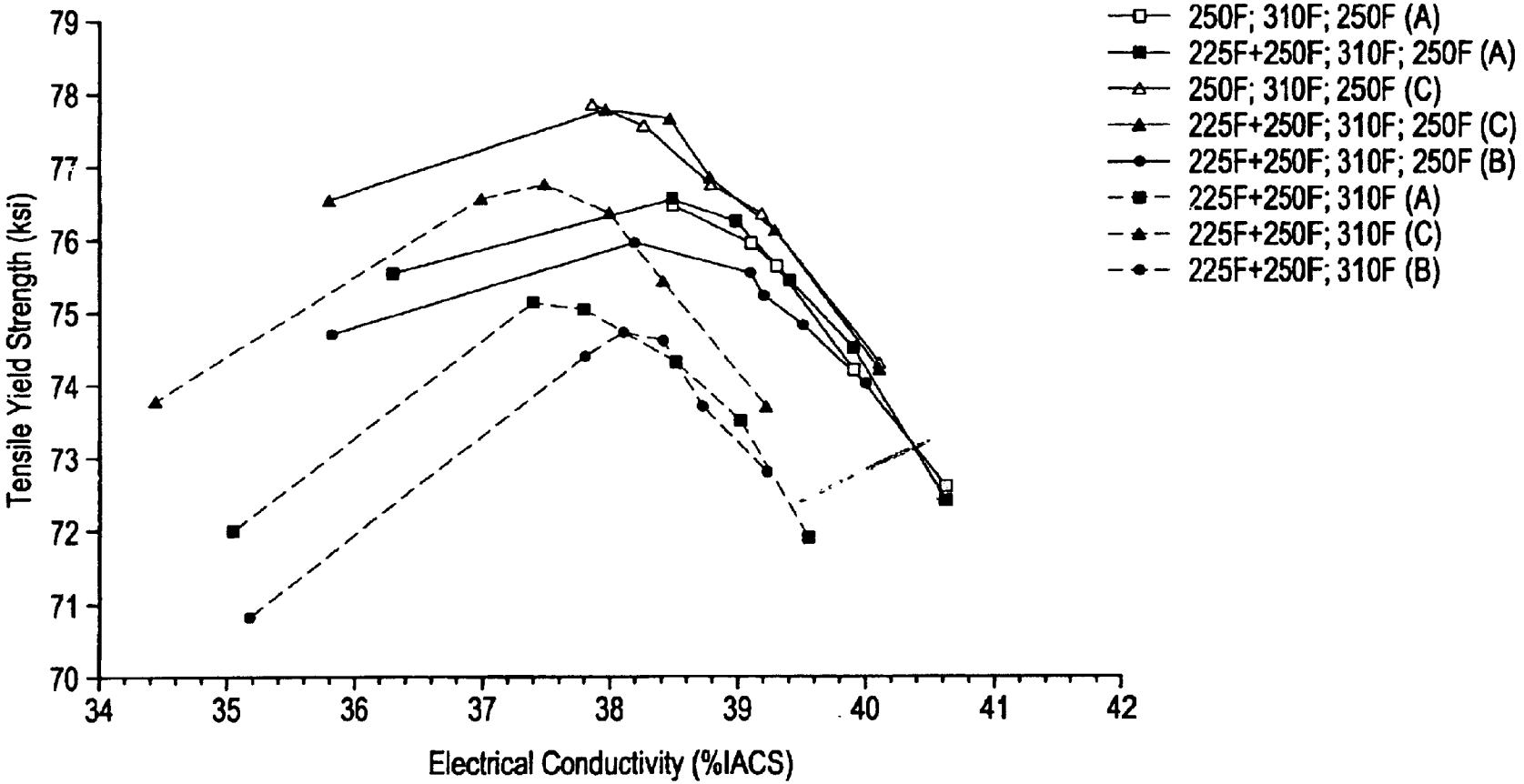
FIG. 9 is a graph comparing longitudinal TYS values (in ksi) versus electrical conductivity EC (as % IACS) for samples from 6 inch thick plate of the invention alloy after aging by a known 2-step aging method versus the preferred 3-step aging practice outlined below. Most notable from this Figure is the surprising and significant strength increase observed at same EC level, or the significant EC level increases observed at the same strength value, for 3-step aged samples as compared to their 2-step aged counterparts. In each case, the first step age was conducted at 225° F., 250° F. or at both temperatures, followed by a second step age at about 310° F.

FIG. 9 is a graph comparing the tensile yield strengths and EC values that were used to provide the interpolated data presented in Table 6 above. Significantly, it was noted that a dramatic increase in EC was observed for the above described, 3-stage aged Alloys A, B or C at the same yield strength level. From that data, it was also noted that a surprising and significant strength increase at the same EC level was observed for the above described, 3-step aged conditions as compared to the 2-step, with the second of each being performed at about 310° F. For example, the yield strength for the 2-step aged Alloy A specimen at 39.5% IACS was 72.1 ksi. But, its TYS value increased to 75.4 ksi when given a 3-step age according to the invention.

Al SCC studies were performed per ASTM Standard D-1141, by alternate immersion, in a specified synthetic ocean water (or SOW) solution, which is more aggressive than the more typical 3.5% NaCl salt solution required by ASTM Standard G44. Table 7 shows the results on various Alloy A, B and C samples (all in an ST direction) with just 2-aging steps, the second step comprising various times (6, 8 and 11 hours) at about 320° F.

TABLE 7

Results of SCC Test by Alternate Immersion of Plant Processed 6" Plates of Alloys A, B and C Receiving 2-StageAging after 121 Days Exposure to Synthetic Ocean Water

| 6 Hours @ 250° F. (1st stage) plus: | Stress (ksi) (T/2) | F/N(1) | Days To Failure | Stress (ksi) (T/2) | F/N(1) | Days To Failure | Stress (ksi) (T/2) | F/N(1) | Days To Failure | EC (% IACS) (Surf) | TYS (ksi) (T/4) |
|---|---|---|---|---|---|---|---|---|---|---|---|
| Alloy A-T7X 6" Plate | | | | | | | | | | | |
| 6 Hr/320 F. | 25 | 1/5 | 77d<br>4 OK @ 121d | 35 | 4/5 | 10, 12, 21, 70d<br>1 OK @ 121d | 40 | 5/5 | 6, 7, 7, 27, 91d | 41.2 | 74.9 |
| 8 Hr/320 F. | 25 | 0/5 | 5 OK @ 121d | 35 | 2/5 | 100, 100d<br>3 OK @ 121d | 40 | 3/5 | 13, 13, 50d<br>2 OK @ 121d | 41.6 | 72.5 |
| 11 Hr/320 F. | 25 | 0/5 | 5 OK @ 121d | 35 | 0/5 | 5 OK @ 121d | 40 | 0/5 | 5 OK @121d | 42.9 | 67.2 |
| Alloy B-T7X 6" Plate | | | | | | | | | | | |
| 6 Hr/320 F. | 25 | 0/5 | 5 OK @ 121d | 35 | 0/5 | 5 OK @ 121d | 40 | 0/5 | 5 OK @ 121d | 41.3 | 74.8 |
| 8 Hr/320 F. | 25 | 0/5 | 5 OK @ 121d | 35 | 0/5 | 5 OK @ 121d | 40 | 0/5 | 5 OK @ 121d | 41.7 | 73.1 |
| 11 Hr/320 F. | 25 | 0/5 | 5 OK @ 121d | 35 | 0/5 | 5 OK @ 121d | 40 | 0/5 | 5 OK @ 121d | 42.2 | 69.2 |
| Alloy C-T7X 6" Plate | | | | | | | | | | | |
| 6 Hr/320 F. | 25 | 1/5 | 13d<br>4 OK @ 121d | 35 | 0/5 | 5 OK @ 121d | 40 | 3/5 | 23, 26, 34d<br>2 OK @ 121d | 40.9 | 75.3 |
| 8 Hr/320 F. | 25 | 0/5 | 5 OK @ 121d | 35 | 0/5 | 5 OK @ 121d | 40 | 3/5 | 13, 19, 35d<br>2 OK @ 121d | 41.2 | 73.9 |
| 11 Hr/320 F. | 25 | 0/5 | 5 OK @ 121d | 35 | 0/5 | 5 OK @121d | 40 | 0/5 | 5 OK @ 121d | 42.2 | 69.2 |

Note: F/N(1) = Number of specimens failed over the number exposed

From this data, several SCC failures were observed following exposure for 121 days, primarily as a function of short transverse (ST) applied stress, aging time and/or alloy.

Comparative Table 8 lists SCC results for just Alloys A and C (applied stress in the same ST direction) after having been aged for an additional 24 hours at 250° F., that is for a total aging practice that comprises: (1) 6 hours at 250° F.; (2) 6, 8 or 11 hours at 320° F.; and (3) 24 hours at 250° F.

TABLE 8

Results of SCC Test by Alternate Immersion of Plant Processed 6" Plates of Alloys A and C Receiving 3-StageAging after 93 Days Exposure to Synthetic Ocean Water by Alternate Immersion ASTM D-1141-90

| 6 Hours @ 250° F. (1st stage) plus: | Stress (ksi) (T/2) | F/N(1) | Days To Failure | Stress (ksi) (T/2) | F/N(1) | Days To Failure | Stress (ksi) (T/2) | F/N(1) | Days To Failure | EC (% IACS) (T/10) | TYS (ksi) (T/4) |
|---|---|---|---|---|---|---|---|---|---|---|---|
| Alloy A-T7X Plate | | | | | | | | | | | |
| 6 Hr/320 F. + 24 h/250 F. | 25 | 0/3 | 3 OK @ 93d | 35 | 0/3 | 3 OK @ 93d | 45 | 0/3 | 3 OK @ 93d | 39.7 | 74.2 |
| 8 Hr/320 F. + 24 h/250 F. | 25 | 0/3 | 3 OK @ 93d | 35 | 0/3 | 3 OK @ 93d | 45 | 0/3 | 3 OK @ 93d | 40.4 | 72.1 |
| 11 Hr/320 F. + 24 h/250 F. | 25 | 0/3 | 3 OK @ 93d | 35 | 0/3 | 3 OK @ 93d | 45 | 0/3 | 3 OK @ 93d | 41.5 | 67.4 |

TABLE 8-continued

Results of SCC Test by Alternate Immersion of Plant Processed 6" Plates of Alloys A and C Receiving 3-StageAging after 93 Days Exposure to Synthetic Ocean Water by Alternate Immersion ASTM D-1141-90

| 6 Hours @ 250° F. (1st stage) plus: | Stress (ksi) (T/2) | F/N(1) | Days To Failure | Stress (ksi) (T/2) | F/N(1) | Days To Failure | Stress (ksi) (T/2) | F/N(1) | Days To Failure | EC (% IACS) (T/10) | TYS (ksi) (T/4) |
|---|---|---|---|---|---|---|---|---|---|---|---|
| Alloy C-T7X Plate | | | | | | | | | | | |
| 6 Hr/320 F. + 24 h/250 F. | 25 | 0/3 | 3 OK @ 93d | 35 | 0/3 | 3 OK @ 93d | 45 | 0/3 | 3 OK @ 93d | 39.5 | 75.3 |
| 8 Hr/320 F. + 24 h/250 F. | 25 | 0/3 | 3 OK @ 93d | 35 | 0/3 | 3 OK @ 93d | 45 | 0/3 | 3 OK @ 93d | 40.0 | 72.8 |
| 11 Hr/320 F. + 24 h/250 F. | 25 | 0/3 | 3 OK @ 93d | 35 | 0/3 | 3 OK @ 93d | 45 | 0/3 | 3 OK @ 93d | 41.0 | 68.8 |

Note: F/N(1) = Number of specimens failed over the number exposed.

Quite remarkably, no sample failures were observed under identical test conditions after the first 93 days of exposure. Thus, the new 3-step aging approach of this invention is believed to confer unique strength/SCC advantages surpassing those achievable through conventional 2-step aging while promising to develop better property attributes in new products and confer further property combination improvements in still other, current aerospace product lines.

The value of comparing Table 7 data to that in Table 8 is to underscore that while 2 stage/step aging may be practiced on the alloy according to this invention, the preferred 3 stage aging method herein described actually imparts a measurable SCC test performance improvement. Tables 6 and 7 also include SCC performance "indicator" data, EC values (as a % IACS), along with correspondingly measured TYS (T/4) values. That data must not be compared, side-by-side, for determining the relative value of a two versus 3 step aged products, however, as the EC testing was performed at different areas of the product, i.e. Table 7 using surface measured values versus the T/10 measurements of Table 8 (it being known that EC indicator values generally decrease when measuring from the surface going inward on a given test specimen). The TYS values cannot be used as a true comparison either as lot sizes varied as well as testing location (laboratory versus plant). Instead, the relative data of FIG. 9 (below) should be consulted for comparing to what extent 3 step aging showed an improved COMBINATION of strength and corrosion resistance performance using longitudinal TYS values (ksi) versus electrical conductivity EC (% IACS) for side-by-side, commonly tested 6 inch thick plate samples of the invention alloy.

Seacoast SCC test data confirms the significant improvements in corrosion resistance realized by imparting a novel three-step aging method to the aforementioned new family of 7XXX alloys. For the alloy composition identified as Alloy A in above Table 4, SCC testing extended over a 568 day period for 2-stage aged versus a 328 day test period for the 3 stage aged, with the comparative 2- versus 3-stage aged SCC performances mapped per following Table 9 (The latter (3 stage) testing was started after the former (2 stage) tests had commenced; hence, the longer test times observed for 2 stage aged specimens).

TABLE 9

Comparison of Short-Transverse Seacoast SCC Performance from 2- versus 3-Step aging Practices with 320° F. 2nd Step A in for Alloy A Days Survived until Failure

| Aging Practice | | 2-Step Aging | | 3-Step Aging | |
|---|---|---|---|---|---|
| Aging Time at 320° F. | | 6 Hrs | 8 Hrs | 7 hrs | 9 hrs |
| L-TYS | | 74.9 ksi | 72.5 ksi | 73.3 ksi | 71.0 ksi |
| Short-Transverse | 23 ksi | | | +++ | +++ |
| Applied Stress | 25 ksi | 39, 39 ⊕ 507, 39 | 46, 39, 46, 39, 46 | +++ | +++ |
| | 27 ksi | | | +++ | +++ |
| | 29 ksi | | | +++ | +++ |
| | 31 ksi | | | +++ | +++ |
| | 33 ksi | | | +++ | +++ |
| | 35 ksi | 39, 39, 39, 39, 39 | 39, 39, 39, 39, 39 | +++ | +++ |
| | 37 ksi | | | 314++ | +++ |
| | 39 ksi | | | +++ | +++ |
| | 40 ksi | 39, 39, 39, 39, 39 | 39, 39, 39, 59, 39 | | |
| | 41 ksi | | | +++ | 265++ |
| | 43 ksi | | | 167 + 167 | +++ |
| | 45 ksi | 39, 39, 39, 39, 39 | 39, 39, 39, 39, 39 | +272, 328 | +++ |
| | 47 ksi | | | 167, 153+ | +++ |
| | 49 ksi | | | 187, 265, 90 | 293 + 237 |
| | 51 ksi | | | 251, 97, 160 | +++ |
| | | ⊕ Specimen surviving 568 Days | | + Specimens surviving 328 Days | |

Note: 2 stage aging comprised: 6 hours @ 250° F.; and 6 or 8 hours @ 320° F.
3 stage aging comprised: 6 hours @ 250° F.; 7 or 9 hours @ 320° F.; and 24 hours @ 250° F.

Figure 10:
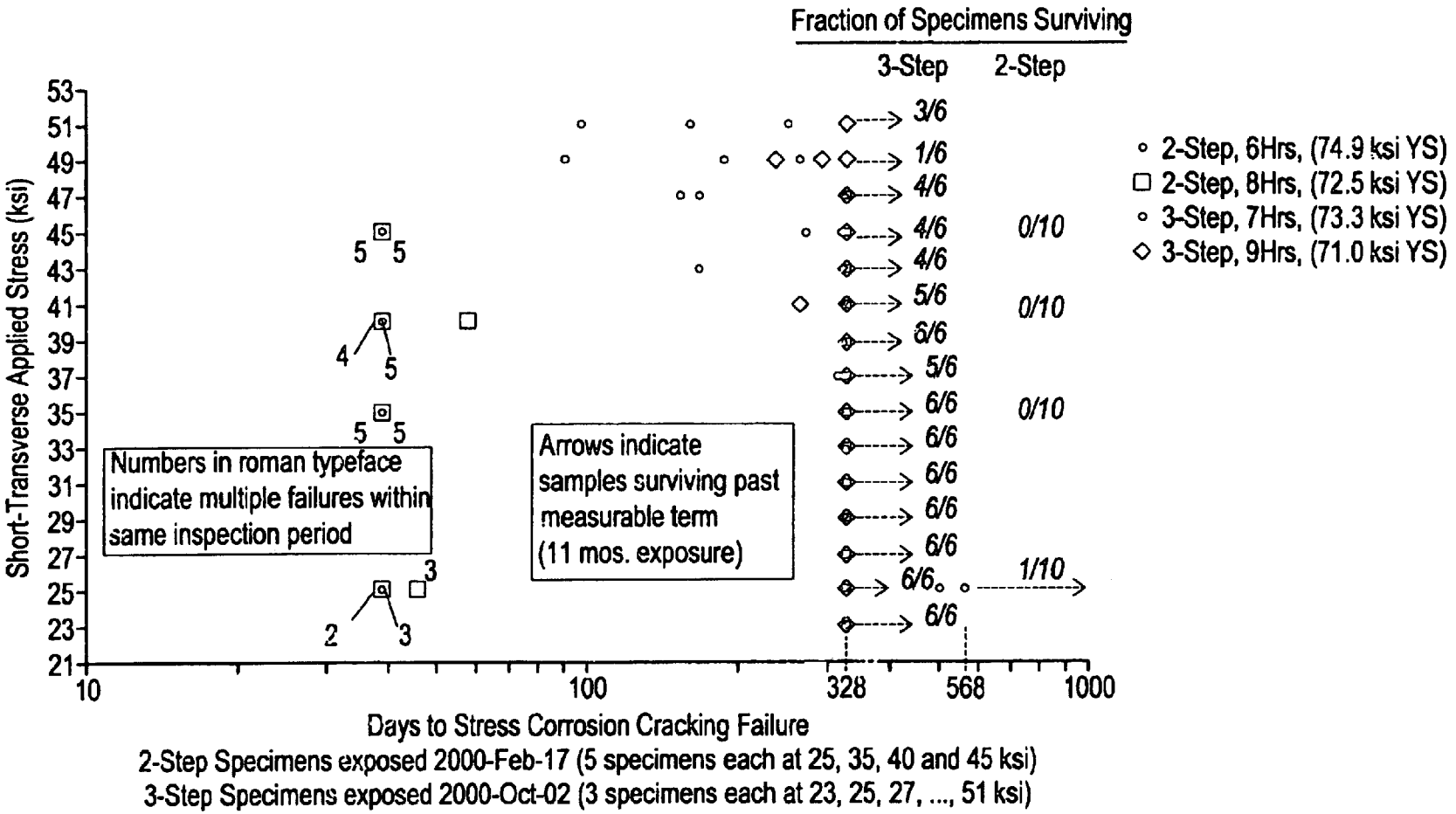
FIG. 10 is a graph depicting the Seacoast SCC performance of 2- versus 3-stage aged for one preferred alloy composition at various short transverse (ST) stress levels, a visual summary of the data found at Table 9 below.

This data is graphically summarized in accompanying FIG. 10 with the times in the upper left key on that Figure always referring to the second step aging times at 320° F., even for the 3 step aged specimens commonly referred to therein.

A second composition, Alloy C in Table 4 (with its 7.4 wt. % Zn, 1.5 wt. % Mg, 1.9 wt. % Cu, and 0.11 wt % Zr), was subjected to the comparative 2- versus 3-step agings as was Alloy A above. The long term results from those Seacoast SCC tests are summarized in Table 10 below.

TABLE 10

Comparison of Short-Transverse Seacoast SCC Performance from 2- versus 3-Step aging Practices with 320° F. 2nd Step Aging for Alloy C Days Survived until Failure

| Aging Practice | | 2-Step Aging | | 3-Step Aging | |
|---|---|---|---|---|---|
| Aging Time at 320° F. | | 6 Hrs | 8 Hrs | 7 Hrs | 9.5 Hrs |
| L-TYS | | 75.3 ksi | 73.9 ksi | 74.3 ksi | 72.8 ksi |
| Short-Transverse | 23 ksi | | | +++ | +++ |
| Applied Stress | 25 ksi | ⊕ ⊕ 39 ⊕ 39 | ⊕ 59 ⊕ ⊕ ⊕ | +++ | +++ |
| | 27 ksi | | | +++ | +++ |
| | 29 ksi | | | +++ | +++ |
| | 31 ksi | | | +++ | +++ |
| | 33 ksi | | | +++ | +++ |
| | 35 ksi | 39, 39, 39, 39, 39 | 59, 39, 67, 73, 39 | +++ | +++ |
| | 37 ksi | | | +++ | +++ |
| | 39 ksi | | | +++ | +++ |
| | 40 ksi | 39, 39, 67, 39, 39 | 39, 39, 39, 46, 67 | | |
| | 41 ksi | | | +++ | +++ |
| | 43 ksi | | | +++ | +++ |
| | 45 ksi | 39, 39, 39, 39, 39 | 39, 53, 39, 39, 39 | ++244 | +++ |
| | 47 ksi | | | +++ | +++ |
| | 49 ksi | | | +272+ | +++ |
| | 51 ksi | | | 181++ | +265+ |
| | | ⊕ Specimen surviving 568 Days | | +0 Specimens surviving 328 Days | |

Figure 11:
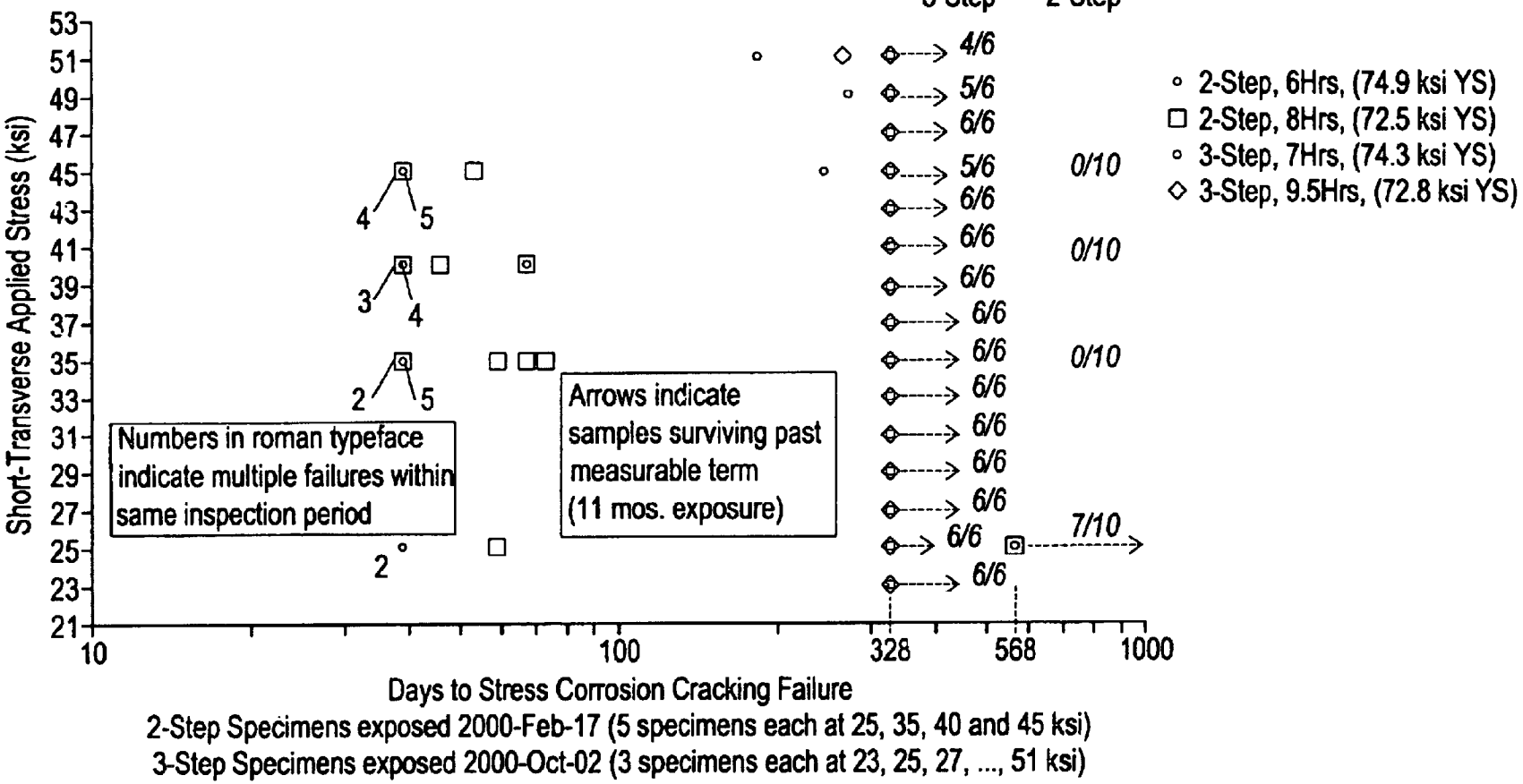
FIG. 11 is a graph depicting the Seacoast SCC performance of 2- versus 3-step aged for a second preferred alloy composition at various short transverse (ST) stress levels, a visual summary of the data found at Table 10 below.

Graphically, this Table 10 data is shown in accompanying FIG. 11 with the times in the upper left key on that Figure always referring to the second step aging times at 320° F., even for the 3 step aged specimens commonly referred to therein. From both the Alloy A and Alloy C data, it is most evident that practicing the preferred 3-step aging process of this invention on its preferred alloy compositions imparts a significant improvement in SCC Seacoast testing performance therefor, especially when the specimen days-to-failure rates of 3-step aged materials are compared side-by-side to the 2-step aged counterparts. Prior to this prolonged SCC Seacoast testing, however, the 2-step aged materials showed some SCC performance enhancements under simulated tests and may be suitable for some applications of the invention alloy even though the improved 3 step/stage aging is preferred.

With respect to the 3-stage aging, preferred particulars for the aforementioned alloy compositions, one must note that: the first stage age should preferably take place within about 200 to 275° F., more preferably between about 225 or 230 to 260° F., and most preferably at or about 250° F. And while about 6 hours at the aforesaid temperature or temperatures is quite satisfactory, it must be noted that in any broad sense, the amount of time spent for first step aging should be a time sufficient for producing a substantial amount of precipitation hardening. Thus, relatively short hold times, for instance of about 2 or 3 hours, at a temperature of about 250° F., may be sufficient (1) depending on part size and shape complexity; and (2) especially when the aforementioned "shortened" treatment/exposure is coupled with a relatively slow heat up rate of several hours, for instance 4 to 6 or 7 hours, total.

The preferred second stage aging practice to be imparted on the preferred alloy compositions of this invention can be purposefully ramped up directly from the aforementioned first step heat treatment. Or, there may be a purposeful and distinct time/temperature interruption between first and second stages. Broadly stated, this second step should take place within about 290 or 300 to 330 or 335° F. Preferably, this second step age is performed within about 305 and 325° F. Preferably, second step aging takes place between about 310 to 320 or 325° F. The preferred exposure times for this critical second step processing depend somewhat inversely on the actual temperature(s) employed. For instance, if one were to operate substantially at or very near 310° F., a total exposure time from about 6 to 18 hours, preferably for about 7 to 13, or even 15 hours would suffice. More preferably, second step agings would proceed for about 10 or 11, even 13, total hours at that operating temperature. At a second aging stage temperature of about 320° F., total second step times can range between about 6 to 10 hours with about 7 or 8 to 10 or 11 hours being preferred. There is also a preferred target property aspect to second step aging time and temperature selection. Most notably, shorter treatment times at a given temperature favor higher strength values whereas longer exposure times favor better corrosion resistance performance.

Finally, with respect to the preferred, third aging practice stage, it is better to not ramp slowly down from the second step for performing this necessary third step on such thick workpieces unless extreme care is exercised to coordinate closely with the second step temperature and total time duration so as to avoid exposures at second aging stage temperatures for too long a time. Between the second and third aging steps, the metal products of this invention can be purposefully removed from the heating furnace and rapidly cooled, using fans or the like, to either about 250° F. or less, perhaps even fully back down to room temperature. In any event, the preferred time/temperature exposures for the third aging step of this invention closely parallel those set forth for the first aging step above.

In accordance with the invention, the invention alloy is preferably made into a product, suitably an ingot derived product, suitable for hot rolling. For instance, large ingots can be semi-continuously cast of the aforesaid composition and then can be scalped or machined to remove surface imperfections as needed or required to provide a good rolling surface. The ingot may then be preheated to homogenize and solutionize its interior structure and a suitable preheat treatment is to heat to a relatively high temperature for this type of composition, such as 900° F. In doing so, it is preferred to heat to a first lesser temperature level such as heating above 800° F., for instance about 820° F. or above, or 850° F. or above, preferably 860° F. or more, for instance around 870° F. or more, and hold the ingot at about that temperature or temperatures for a significant time, for instance, 3 or 4 hours. Next the ingot is heated the rest of the way up to a temperature of around 890° F. or 900° F. or possibly more for another hold time of a few hours. Such stepped or staged heat ups for homogenizing have been known in the art for many years. It is preferred that homogenizing be conducted at cumulative hold times in the neighborhood of 4 to 20 hours or more, the homogenizing temperatures referring to temperatures above about 880 to 890° F. That is, the cumulative hold time at temperatures above about 890° F. should be at least 4 hours and preferably more, for instance 8 to 20 or 24 hours, or more. As is known, larger ingot size and other matters can suggest longer homogenizing times. It is preferred that the combined total volume percent of insoluble and soluble constituents be kept low, for instance not over 1.5 vol. %, preferably not over 1 vol. %. Use of the herein described relatively high preheat or homogenization and solution heat treat temperatures aid in this respect, although high temperatures warrant caution to avoid partial melting. Such cautions can include careful heat-ups including slow or step-type heating, or both.

The ingot is then hot rolled and it is desirable to achieve an unrecrystallized grain structure in the rolled plate product. Hence, the ingot for hot rolling can exit the furnace at a temperature substantially above about 820° F., for instance around 840 to 850° F. or possibly more, and the rolling operation is carried out at initial temperatures above 775° F., or better yet, above 800° F., for instance around 810 or even 825° F. This increases the likelihood of reducing recrystallization and it is also preferred in some situations to conduct the rolling without a reheating operation by using the power of the rolling mill and heat conservation during rolling to maintain the rolling temperature above a desired minimum, such as 750° F. or so. Typically, in practicing the invention, it is preferred to have a maximum recrystallization of about 50% or less, preferably about 35% or less, and most preferably no more than about 25% recrystallization, it being understood that the less recrystallization achieved, the better the fracture toughness properties.

Hot rolling is continued, normally in a reversing hot rolling mill, until the desired thickness of the plate is achieved. In accordance with the invention, plate product intending to be machined into aircraft components such as integral spars can range from about 2 to 3 inches to about 9 or 10 inches thick or more. Typically, this plate ranges from around 4 inches thick for relatively smaller aircraft, to thicker plate of about 6 or 8 inches to about 10 or 12 inches or more. In addition to the preferred embodiments, it is believed this invention can be used to make the lower wing skins of small, commercial jet airliners. Still other applications can include forgings and extrusions, especially thick sectioned versions of same. In making extrusion, the invention alloy is extruded within around 600° to 750° F., for instance, at around 700° F., and preferably includes a reduction in cross-sectional area (extrusion ratio) of about 10:1 or more. Forging can also be used herein.

The hot rolled plate or other wrought product is solution heat treated (SHT) by heating within around 840 or 850° F. to 880 or 900° F. to take into solution substantial portions, preferably all or substantially all, of the zinc, magnesium and copper soluble at the SHT temperature, it being understood that with physical processes which are not always perfect, probably every last vestige of these main alloying ingredients may not be fully dissolved during the SHT (solutionizing). After heating to the elevated temperature as just described, the product should be quenched to complete the solution heat treating procedure. Such cooling is typically accomplished either by immersion in a suitably sized tank of cold water or by water sprays, although air chilling might be usable as supplementary or substitute cooling means for some cooling. After quenching, certain products may need to be cold worked, such as by stretching or compression, so as to relieve internal stresses or straighten the product, even possibly in some cases, to further strengthen the plate product. For instance, the plate may be stretched or compressed 1 or 1½ or possibly 2% or 3% or more, or otherwise cold worked a generally equivalent amount. A solution heat treated (and quenched) product, with or without cold working, is then considered to be in a precipitation-hardenable condition, or ready for artificial aging according to preferred artificial aging methods as herein described or other artificial aging techniques. As used herein, the term "solution heat treat", unless indicated otherwise, shall be meant to include quenching.

After quenching, and cold working if desired, the product (which may be a plate product) is artificially aged by heating to an appropriate temperature to improve strength and other properties. In one preferred thermal aging treatment, the precipitation hardenable plate alloy product is subjected to three main aging steps, phases or treatments as described above, although clear lines of demarcation may not exist between each step or phase. It is generally known that ramping up to and/or down from a given or target treatment temperature, in itself, can produce precipitation (aging) effects which can, and often need to be, taken into account by integrating such ramping conditions and their precipitation hardening effects into the total aging treatment.

It is also possible to use aging integration in conjunction with the aging practices of this invention. For instance, in a programmable air furnace, following completion of a first stage heat treatment of 250° F. for 24 hours, the temperature in that same furnace can be gradually progressively raised to temperature levels around 310° or so over a suitable length of time, even with no true hold time, after which the metal can then be immediately transferred to another furnace already stabilized at 250° F. and held for 6 to 24 hours. This more continuous, aging regime does not involve transitioning to room temperature between first-to-second and second-to-third stage aging treatments. Such aging integration was described in more detail in U.S. Pat. No. 3,645,804, the entire content of which is fully incorporated by reference herein. With ramping and its corresponding integration, two, or on a less preferred basis, possibly three, phases for artificially aging the plate product may be possible in a single, programmable furnace. For purposes of convenience and ease of understanding, however, preferred embodiments of this invention have been described in more detail as if each stage, step or phase was distinct from the other two artificial aging practices imposed hereon. Generally speaking, the first of these three steps or stages is believed to precipitation harden the alloy product in question; the second (higher temperature) stage then exposes the invention alloy to one or more elevated temperatures for increasing its resistance to corrosion, especially stress corrosion cracking (SCC) resistance under both normal, industrial and seacoast-simulated atmospheric conditions. The third and final stage then further precipitation hardens the invention alloy to a high strength level while also imparting further improved corrosion properties thereto.

The low quench sensitivity of the invention alloy can offer yet another potential application in a class of processes generally described as "press quenching" by those skilled in the art. One can illustrate the "press quenching" process by considering the standard manufacturing flow path of an age hardenable extrusion alloy such as one that belongs to the 2XXX, 6XXX, 7XXX or 8XXX alloy series. The typical flow path involves: Direct Chill (DC) ingot casting of billets, homogenization, cooling to ambient temperature, reheating to the extrusion temperature by furnaces or induction heaters, extrusion of the heated billet to final shape, cooling the extruded part to ambient temperature, solution heat treating the part, quenching, stretching and either naturally aged at room temperature or artificially aged at elevated temperature to the final temper. The "press quenching" process involves controlling the extrusion temperature and other extrusion conditions such that upon exiting the extrusion die, the part is at or near the desired solution heating temperature and the soluble constituents are effectively brought to solid solution. It is then immediately and directly continuously quenched as the part exits the extrusion press by either water, pressurized air or other media. The press quenched part can then go through the usual stretching, followed by either natural or artificial aging. Hence, as compared to the typical flow path, the costly separate solution heat treating process is eliminated from this press quenched variation, thereby significantly lowering overall manufacturing costs, and energy consumption as well.

For most alloys, especially those belonging to the relatively quench sensitive 7XXX alloy series, the quench provided by the press quenching process is generally not as effective as compared to that provided by the separate solution heat treatment, such that significant degradation of certain material attributes such as strength, fracture toughness, corrosion resistance and other properties can result from press quenching. Since the invention alloy has very low quench sensitivity, it is expected that the property degradation during press quenching is either eliminated or significantly reduced to acceptable levels for many applications.

For the mold plate embodiments of this invention where SCC resistance is not as critical, known single or two-stage artificial aging treatments may also be practiced on these compositions instead of the preferred three step aging method described herein.

When referring to a minimum (for instance, strength or toughness property value), such can refer to a level at which specifications for purchasing or designating materials can be written or a level at which a material can be guaranteed or a level that an airframe builder (subject to safety factor) can rely on in design. In some cases, it can have a statistical basis wherein 99% of the product conforms or is expected to conform with 95% confidence using standard statistical methods. Because of an insufficient amount of data, it is not statistically accurate to refer to certain minimum or maximum values of the invention as true "guaranteed" values. In those instances, calculations have been made from currently available data for extrapolating values (e.g. maximums and minimums) therefrom. See, for example, the Currently Extrapolated Minimum S/N values plotted for plate (solid line A—A in FIG. 12) and forgings (solid line B—B in FIG. 13), and the Currently Extrapolated FCG Maximum (solid line C—C in FIG. 14).

Fracture toughness is an important property to airframe designers, particularly if good toughness can be combined with good strength. By way of comparison, the tensile strength, or ability to sustain load without fracturing, of a structural component under a tensile load can be defined as the load divided by the area of the smallest section of the component perpendicular to the tensile load (net section stress). For a simple, straight-sided structure, the strength of the section is readily related to the breaking or tensile strength of a smooth tensile coupon. This is how tension testing is done. However, for a structure containing a crack or crack-like defect, the strength of a structural component depends on the length of the crack, the geometry of the structural component, and a property of the material known as the fracture toughness. Fracture toughness can be thought of as the resistance of a material to the harmful or even catastrophic propagation of a crack under a load.

Fracture toughness can be measured in several ways. One way is to load in tension a test coupon containing a crack. The load required to fracture the test coupon divided by its net section area (the cross-sectional area less the area containing the crack) is known as the residual strength with units of thousands of pounds force per unit area (ksi). When the strength of the material as well as the specimen geometry are constant, the residual strength is a measure of the fracture toughness of the material. Because it is so dependent on strength and specimen geometry, residual strength is usually used as a measure of fracture toughness when other methods are not as practical as desired because of some constraint like size or shape of the available material.

When the geometry of a structural component is such that it does not deform plastically through the thickness when a tension load is applied (plane-strain deformation), fracture toughness is often measured as plane-strain fracture toughness, $K_{Ic}$. This normally applies to relatively thick products or sections, for instance 0.6 or preferably 0.8 or 1 inch or more. The ASTM has established a standard test using a fatigue pre-cracked compact tension specimen to measure $K_{Ic}$ which has the units ksi√in. This test is usually used to measure fracture toughness when the material is thick because it is believed to be independent of specimen geometry as long as appropriate standards for width, crack length and thickness are met. The symbol K, as used in $K_{Ic}$, is referred to as the stress intensity factor.

Structural components which deform by plane-strain are relatively thick as indicated above. Thinner structural components (less than 0.8 to 1 inch thick) usually deform under plane stress or more usually under a mixed mode condition. Measuring fracture toughness under this condition can introduce variables because the number which results from the test depends to some extent on the geometry of the test coupon. One test method is to apply a continuously increasing load to a rectangular test coupon containing a crack. A plot of stress intensity versus crack extension known as an R-curve (crack resistance curve) can be obtained this way. The load at a particular amount of crack extension based on a 25% secant offset in the load vs. crack extension curve and the effective crack length at that load are used to calculate a measure of fracture toughness known as $K_{R25}$. At a 20% secant, it is known as $K_{R20}$. It also has the units of ksi√in. Well known ASTM E561 concerns R-curve determination, and such is generally recognized in the art.

When the geometry of the alloy product or structural component is such that it permits deformation plastically through its thickness when a tension load is applied, fracture toughness is often measured as plane-stress fracture toughness which can be determined from a center cracked tension test. The fracture toughness measure uses the maximum load generated on a relatively thin, wide pre-cracked specimen. When the crack length at the maximum load is used to calculate the stress-intensity factor at that load, the stress-intensity factor is referred to as plane-stress fracture toughness $K_c$. When the stress-intensity factor is calculated using the crack length before the load is applied, however, the result of the calculation is known as the apparent fracture toughness, $K_{app}$, of the material. Because the crack length in the calculation of $K_c$ is usually longer, values for $K_c$ are usually higher than $K_{app}$ for a given material. Both of these measures of fracture toughness are expressed in the units ksi√in. For tough materials, the numerical values generated by such tests generally increase as the width of the specimen increases or its thickness decreases as is recognized in the art. Unless indicated otherwise herein, plane stress ($K_c$) values referred to herein refer to 16-inch wide test panels. Those skilled in the art recognize that test results can vary depending on the test panel width, and it is intended to encompass all such tests in referring to toughness. Hence, toughness substantially equivalent to or substantially corresponding to a minimum value for $K_c$ or $K_{app}$ in characterizing the invention products, while largely referring to a test with a 16-inch panel, is intended to embrace variations in $K_c$ or $K_{app}$ encountered in using different width panels as those skilled in the art will appreciate.

The temperature at which the toughness is measured can be significant. In high altitude flights, the temperature encountered is quite low, for instance, minus 65° F., and for newer commercial jet aircraft projects, toughness at minus 65° F. is a significant factor, it being desired that the lower wing material exhibit a toughness $K_{Ic}$ level of around 45 ksi√in at minus 65° F. or, in terms of $K_{R20}$, a level of 95 ksi√in, preferably 100 ksi√in or more. Because of such higher toughness values, lower wings made from these alloys may replace today's 2000 (or 2XXX Series) alloy counterparts with their corresponding property (i.e. strength/toughness) trade-offs. Through the practice of this invention, it may also be possible to make upper wing skins from same, alone or in combination with integrally formed components, like stiffeners, ribs and stringers.

The toughness of the improved products according to the invention is very high and in some cases may allow the aircraft designer's focus for a material's durability and damage tolerance to emphasize fatigue resistance as well as fracture toughness measurement. Resistance to cracking by fatigue is a very desirable property. The fatigue cracking referred to occurs as a result of repeated loading and unloading cycles, or cycling between a high and a low load such as when a wing moves up and down. This cycling in load can occur during flight due to gusts or other sudden changes in air pressure, or on the ground while the aircraft is taxing. Fatigue failures account for a large percentage of failures in aircraft components. These failures are insidious because they can occur under normal operating conditions without excessive overloads, and without warning. Crack evolution is accelerated because material inhomogeneities act as sites for initiation or facilitate linking of smaller cracks. Therefore, process or compositional changes which improve metal quality by reducing the severity or number of harmful inhomogeneities improve fatigue durability.

Stress-life cycle (S-N or S/N) fatigue tests characterize a material resistance to fatigue initiation and small crack growth which comprises a major portion of total fatigue life. Hence, improvements in S-N fatigue properties may enable a component to operate at higher stresses over its design life or operate at the same stress with increased lifetime. The former can translate into significant weight savings by downsizing, or manufacturing cost saving by component or structural simplification, while the latter can translate into fewer inspections and lower support costs. The loads during fatigue testing are below the static ultimate or tensile strength of the material measured in a tensile test and they are typically below the yield strength of the material. The fatigue initiation fatigue test is an important indicator for a buried or hidden structural member such as a wing spar which is not readily accessible for visual or other examination to look for cracks or crack starts.

If a crack or crack-like defect exists in a structure, repeated cyclic or fatigue loading can cause the crack to grow. This is referred to as fatigue crack propagation. Propagation of a crack by fatigue may lead to a crack large enough to propagate catastrophically when the combination of crack size and loads are sufficient to exceed the material's fracture toughness. Thus, performance in the resistance of a material to crack propagation by fatigue offers substantial benefits to aerostructure longevity. The slower a crack propagates, the better. A rapidly propagating crack in an airplane structural member can lead to catastrophic failure without adequate time for detection, whereas a slowly propagating crack allows time for detection and corrective action or repair. Hence, a low fatigue crack growth rate is a desirable property.

The rate at which a crack in a material propagates during cyclic loading is influenced by the length of the crack. Another important factor is the difference between the maximum and the minimum loads between which the structure is cycled. One measurement including the effects of crack length and the difference between maximum and minimum loads is called the cyclic stress intensity factor range or $\Delta K$, having units of ksi√in, similar to the stress intensity factor used to measure fracture toughness. The stress intensity factor range ($\Delta K$) is the difference between the stress intensity factors at the maximum and minimum loads. Another measure affecting fatigue crack propagation is the ratio between the minimum and the maximum loads during cycling, and this is called the stress ratio and is denoted by R, a ratio of 0.1 meaning that the maximum load is 10 times the minimum load. The stress, or load, ratio may be positive or negative or zero. Fatigue crack growth rate testing is typically done in accordance with ASTM E647-88 (and others) well known in the art. As used herein, Kt refers to a theoretical stress concentration factor as described in ASTM E 1823.

The fatigue crack propagation rate can be measured for a material using a test coupon containing a crack. One such test specimen or coupon is about 12 inches long by 4 inches wide having a notch in its center extending in a cross-wise direction (across the width; normal to the length). The notch is about 0.032 inch wide and about 0.2 inch long including a 60° bevel at each end of the slot. The test coupon is subjected to cyclic loading and the crack grows at the end(s) of the notch. After the crack reaches a predetermined length, the length of the crack is measured periodically. The crack growth rate can be calculated for a given increment of crack extension by dividing the change in crack length (called $\Delta a$) by the number of loading cycles ($\Delta N$) which resulted in that amount of crack growth. The crack propagation rate is represented by $\Delta a/\Delta N$ or 'da/dN' and has units of inches/cycle. The fatigue crack propagation rates of a material can be determined from a center cracked tension panel. In a comparison using R=0.1 tested at a relative humidity over 90% with ΔK ranging from around 4 to 20 or 30, the invention material exhibited relatively good resistance to fatigue crack growth. However, the superior performance in S-N fatigue makes the invention material much better suited for a buried or hidden member such as a wing spar.

The invention products exhibit very good corrosion resistance in addition to the very good strength and toughness and damage tolerance performance. The exfoliation corrosion resistance for products in accordance with the invention can be EB or better (meaning "EA" or pitting only) in the EXCO test for test specimens taken at either mid-thickness (T/2) or one-tenth of the thickness from the surface (T/10) ("T" being thickness) or both. EXCO testing is known in the art and is described in well known ASTM Standard No. G34. An EXCO rating of "EB" is considered good corrosion resistance in that it is considered acceptable for some commercial aircraft; "EA" is still better.

Stress corrosion cracking resistance across the short transverse direction is often considered an important property especially in relatively thick members. The stress corrosion cracking resistance for products in accordance with the invention in the short transverse direction can be equivalent to that needed to pass a ⅛-inch round bar alternate immersion test for 20, or alternately 30, days at 25 or 30 ksi or more, using test procedures in accordance with ASTM G47 (including ASTM G44 and G38 for C-ring specimens and G49 for ⅛-inch bars), said ASTM G47, G44, G49 and G38, all well known in the art.

As a general indicator of exfoliation corrosion and stress corrosion resistance, the plate typically can have an electrical conductivity of at least about 36, or preferably 38 to 40% or more of the International Annealed Copper Standard (% IACS). Thus, the good exfoliation corrosion resistance of the invention is evidenced by an EXCO rating of "EB" or better, but in some cases other measures of corrosion resistance may be specified or required by airframe builders, such as stress corrosion cracking resistance or electrical conductivity. Satisfying any one or more of these specifications is considered good corrosion resistance.

The invention has been described with some emphasis on wrought plate which is preferred, but it is believed that other product forms may be able to enjoy the benefits of the invention, including extrusions and forgings. To this point, the emphasis has been on stiffener-type, fuselage or wing skin stringers which can be J-shaped, Z- or S-shaped, or even in the shape of a hat-shaped channel. The purpose of such stiffeners is to reinforce the plane's wing skin or fuselage, or any other shape that can be attached to same, while not adding a lot of weight thereto. While in some cases it is preferred for manufacturing economies to separately fasten stringers, such can be machined from a much thicker plate by the removal of the metal between the stiffener geometries, leaving only the stiffener shapes integral with the main wing skin thickness, thus eliminating all the rivets. Also the invention has been described in terms of thick plate for machining wing spar members as explained above, the spar member generally corresponding in length to the wing skin material. In addition, significant improvements in the properties of this invention render its use as thickly cast mold plate highly practical.

Because of its reduced quench sensitivity, it is believed that when an alloy product according to the invention is welded to a second product, it will exhibit in its heat affected, welding zone an improved retention of its strength, fatigue, fracture toughness and/or corrosion resistance properties. This applies regardless of whether such alloy products are welded by solid state welding techniques, including friction stir welding, or by known or subsequently developed fusion techniques including, but not limited to, electron beam welding and laser welding Through the practice of this invention, both welded parts may be made from the same alloy composition.

For some parts/products made according to the invention, it is likely that such parts/products may be age formed. Age forming promises a lower manufacturing cost while allowing more complex wing shapes to be formed, typically on thinner gauge components. During age forming, the part is mechanically constrained in a die at an elevated temperature usually about 250° F. or higher for several to tens of hours, and desired contours are accomplished through stress relaxation. Especially during a higher temperature artificial aging treatment, such as a treatment above about 320° F., the metal can be formed or deformed into a desired shape. In general, the deformations envisioned are relatively simple such as including a very mild curvature across the width of a plate member together with a mild curvature along the length of said plate member. It can be desirable to achieve the formation of these mild curvature conditions during the artificial aging treatment, especially during the higher temperature, second stage artificial aging temperature. In general, the plate material is heated above around 300° F., for instance around 320 or 330° F., and typically can be placed upon a convex form and loaded by clamping or load application at opposite edges of the plate. The plate more or less assumes the contour of the form over a relatively brief period of time but upon cooling springs back a little when the force or load is removed. The expected springback is compensated for in designing the curvature or contour of the form which is slightly exaggerated with respect to the desired forming of the plate to compensate for springback. Most preferably, the third artificial aging stage at a low temperature such as around 250° F. follows age forming. Either before or after its age forming treatment, the plate member can be machined, for instance, such as by tapering the plate such that the portion intended to be closer to the fuselage is thicker and the portion closest to the wing tip is thinner. Additional machining or other shaping operations, if desired, can also be performed either before or after age forming. High capacity aircrafts may require a relatively thicker plate and a higher level of forming than previously used on a large scale for thinner plate sections.

Various invention alloy product forms, i.e. both thick plate (FIG. 12) and forgings (FIG. 13), were made, aged and suitably sized samples taken for performing fatigue life (S/N) tests thereon consistent with known open hole fatigue life testing procedures. Precise compositions for these product forms were as follows:

TABLE 11

Invention Alloy Compositions

| Product | Zn (wt. %) | Mg (wt. %) | Cu (wt. %) | Zr (wt. %) | Fe (wt. %) | Si (wt. %) |
|---|---|---|---|---|---|---|
| Plate D, F & G and Forging D | 7.25 | 1.45 | 1.54 | 0.11 | 0.03 | 0.007 |
| Plate E and Forging E | 7.63 | 1.42 | 1.62 | 0.11 | 0.04 | 0.007 |

For these open hole fatigue life evaluations, in the L-T orientation, specific test parameters for both plate and forged product forms included: a $K_t$ value of 2.3, Frequency of 30 Hz, R value=0.1 and Relative Humidity (RH) greater than 90%. The plate test results were then graphed in accompanying FIG. 12; and the forging results in accompanying FIG.

13. Both plate and forging forms were tested over several product thicknesses (4, 6 and 8 inches).

Figure 12:
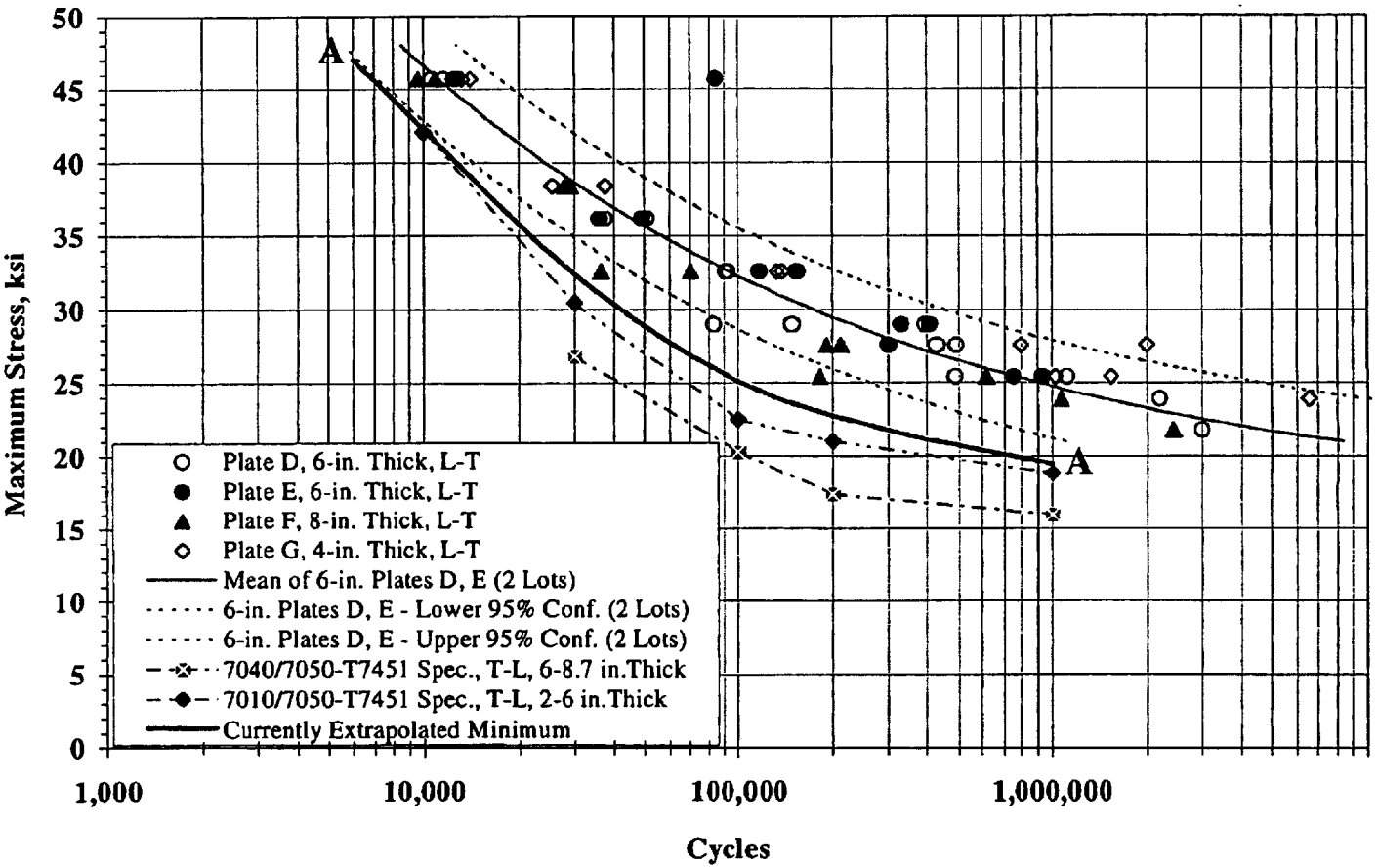
FIG. 12 is a graph plotting open hole fatigue life, in the L-T orientation, for various sized plate samples of the invention, from which a 95% confidence S/N band (dotted lines) and a currently extrapolated preferred minimum performance (solid line A—A) were drawn and compared with one jetliner manufacturer's specified values for 7040/7050-T7451 and 7010/7050-T7451 plate product, albeit in a different (T-L) orientation.

Referring now to FIG. 12, a mean S/N performance (solid) line drawn through both sets of 6 inch thick plate data (alloys D and E above). A 95% confidence band was then drawn (per the upper and lower dotted lines) around the aforementioned 6 inch "mean" performance line. From that data, a set of points was mapped representing currently extrapolated minimum open hole fatigue life (S/N) values. Those precise mapped points were:

TABLE 12

Currently Extrapolated Minimum S/N Plate Values (L-T)

| Applied Maximum Stress (ksi) | Minimum Cycles to Failure |
|---|---|
| 47.0 | 6,000 |
| 42.3 | 10,000 |
| 32.4 | 30,000 |
| 25.1 | 100,000 |
| 21.8 | 300,000 |
| 19.5 | 1,000,000 |

Solid line (A—A) was then drawn on FIG. 12 to connect the aforementioned currently extrapolated minimum S/N values of Table 12. Against those preferred minimum S/N values, one jetliner manufacturer's specified S/N value lines for 7040/7050-T7451 plate (6 to 8.7 inch thick) and 7010/7050-T7451plate (2 to 6 inch thick) were overlaid. Line A—A shows this invention's likely relative improvement in fatigue life S/N performance over known, commercial aerospace 7XXX alloys even though the comparative data for the latter known alloys was taken in a different (T-L) orientation.

From the open hole fatigue life (S/N) data for various sized (i.e. 4 inch, 6 inch and 8 inch) forgings, a dotted line was drawn for mathematically representing the mean values of 6 inch thick comp E and 8 inch thick comp D forgings. Note, several samples tested did not fracture during these tests; they are grouped together in a circle to the right of FIG. 13. Thereafter, a set of points was mapped representing currently extrapolated minimum open hole fatigue life (S/N) values. Those precise mapped points were:

TABLE 13

Currently Extrapolated Minimum S/N Forging Values (L-T)

| Applied Maximum Stress (ksi) | Minimum Cycles to Failure |
|---|---|
| 42.0 | 8,000 |
| 39.4 | 10,000 |
| 30.8 | 30,000 |
| 25.1 | 100,000 |
| 21.8 | 300,000 |
| 19.2 | 1,000,000 |

Figure 13:
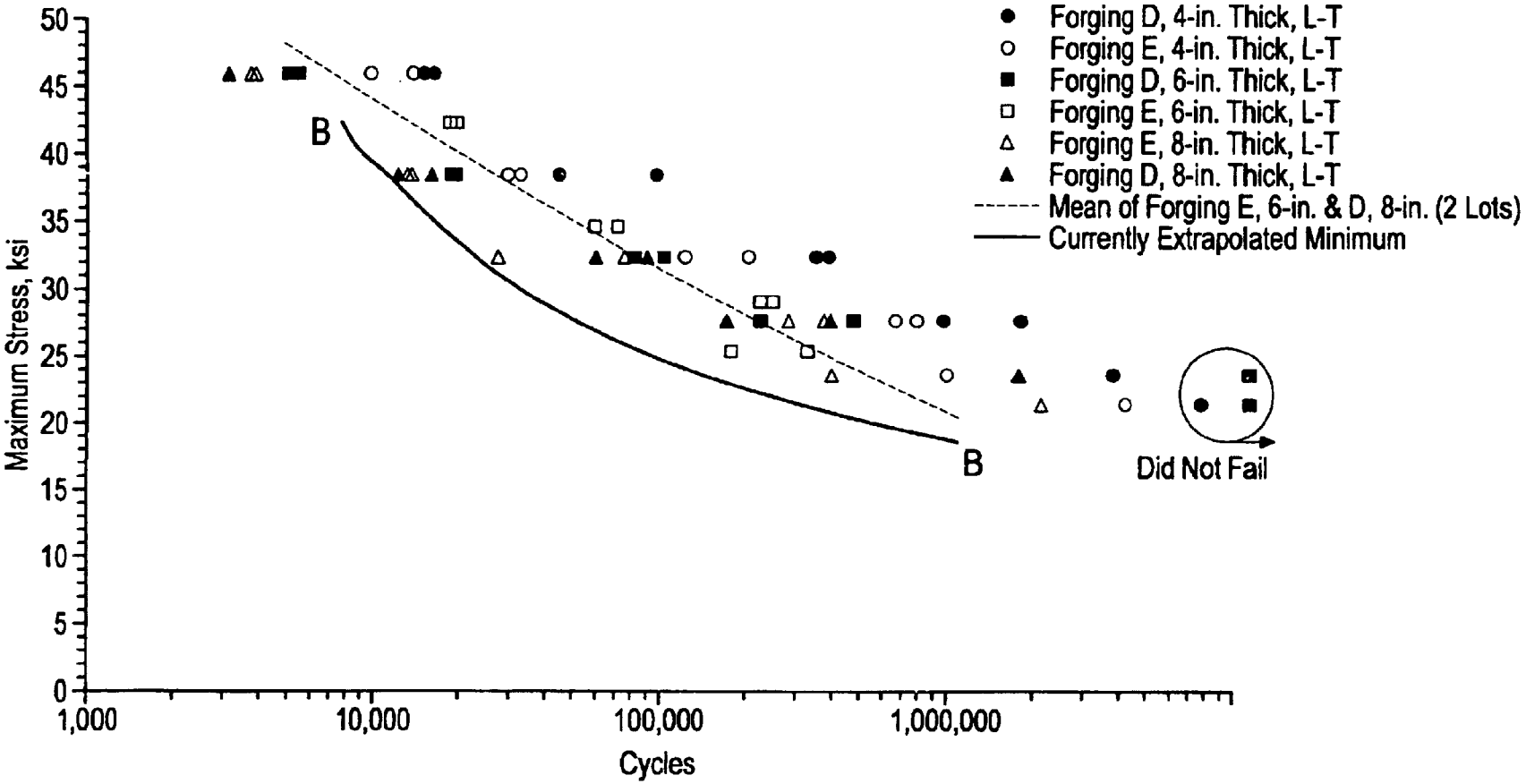
FIG. 13 is a graph plotting open hole fatigue life, in the L-T orientation, for various sized forgings of the invention, from which a mean value line (dotted) and a currently extrapolated preferred minimum performance (solid line B—B) were drawn.

Solid line (B—B) was then drawn on FIG. 13 to connect the aforementioned currently extrapolated minimum S/N forging values of above Table 13.

Figure 14:
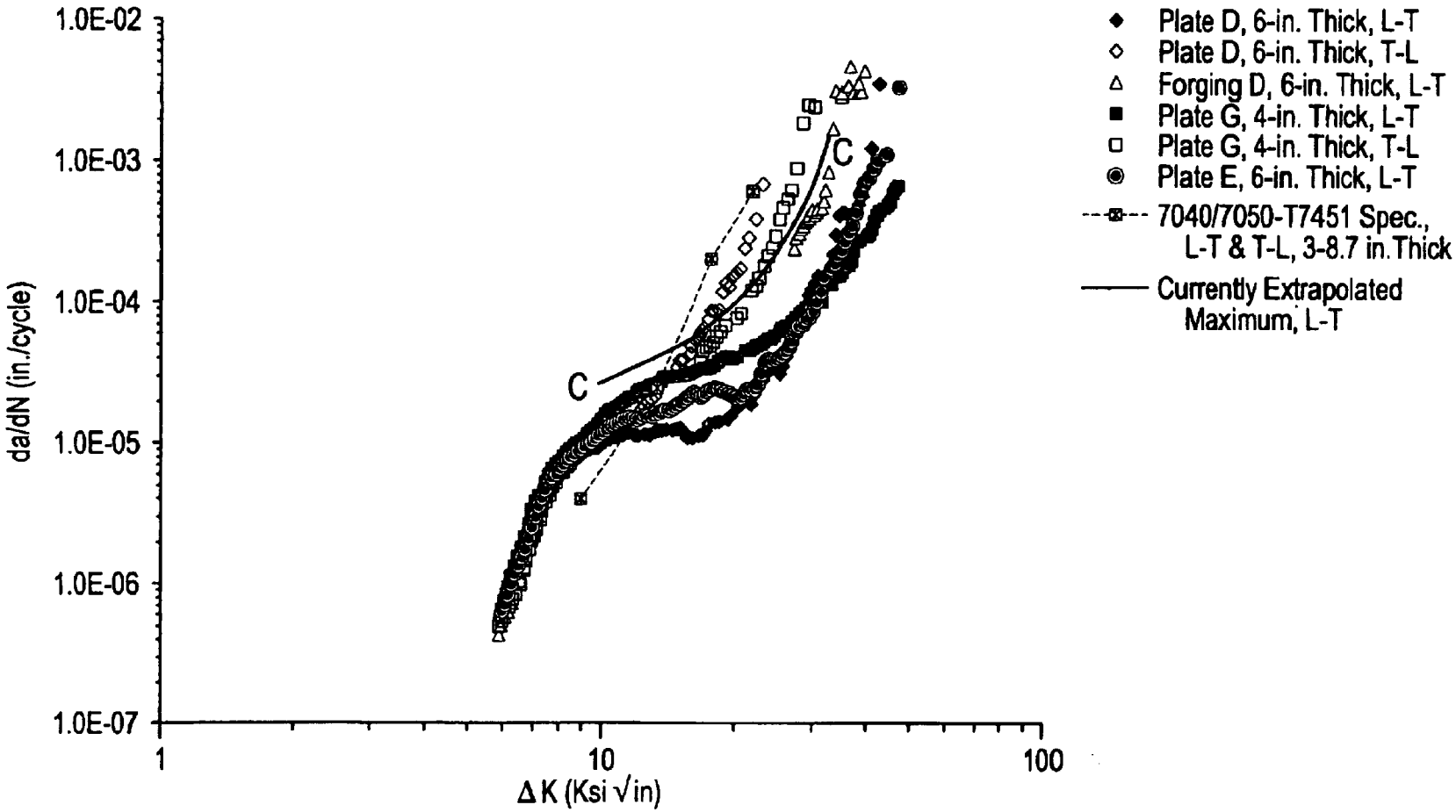
FIG. 14 is a graph plotting fatigue crack growth (FCG) rate curves, in the L-T and T-L orientations, for various sized plate and forgings of the invention, from which a currently extrapolated, FCG preferred maximum curve (solid line C—C) was drawn and compared with the FCG curves specified by one jetliner manufacturer for the same size range 7040/7050-T7451 commercial plate of FIG. 12 in the same (L-T and T-L) orientations.

In FIG. 14, the Fatigue Crack Growth (FCG) rate curves for plate (4 and 6 inch thicknesses, both L-T and T-L orientations) and forged product (6 inch, L-T only) made according to the invention are plotted. The actual compositions tested are listed in above Table 11. These tests, conducted per the FCG procedures described above, employed particulars of: Frequency=25 Hz, an R value=0.1 and relative humidity (RH) greater than 95%. From those curves, for the various product forms and thicknesses, one set of data points was mapped representing currently extrapolated maximum FCG values for the invention. Those precise points were:

TABLE 14

Currently Extrapolated Maximum L-T, FCG Values

| Δ K (ksi$\sqrt{in}$) | Max. da/dN (in./cycle) |
|---|---|
| 10 | 0.000025 |
| 15 | 0.000047 |
| 20 | 0.00009 |
| 25 | 0.0002 |
| 30 | 0.0005 |
| 34 | 0.0014 |

A currently extrapolated maximum FCG value, solid curve line (C—C) for thick plate and forging per the invention was drawn, against which one jetliner manufacturer's specified FCG values for 7040/7050-T7451 (3 to 8.7 in thick) plate was overlaid, said values being taken in both the L-T and T-L orientation.

Plate product forms of the invention have also been subjected to hole crack initiation tests, involving the drilling of a preset hole (less than 1 in diameter) into a test specimen, inserting into that drilled hole a split sleeve, then pulling a variably oversized mandrel through said sleeve and pre-drilled hole. Under such testing, the 6 and 8 inch thick plate product of this invention did not have any cracks initiate from the drilled holes thereby showing very good performance.

Having described the presently preferred embodiments, it is to be understood that the invention may be otherwise embodied within the scope of the appended claims.

What is claimed is:

1. An aluminum alloy aerospace structural component that in solution heat treated, quenched and artificially aged condition, exhibits an improved combination of strength and fracture toughness, said alloy consisting essentially of:

7 to 9.5 wt. % Zn; 1.3 to 1.68 wt. % Mg; 1.3 to 1.9 wt. % Cu; one or more elements present selected from the group consisting of: up to about 0.4 wt. % Zr, up to about 0.4 wt. % Sc and up to about 0.3 wt. % Hf; said alloy optionally containing one or more of up to about 0.06 wt. % Ti, up to about 0.03 wt. % Ca, up to about 0.03 wt. % Sr, up to about 0.002 wt. % Be, said alloy containing less than 0.1 wt. % Mn and less than 0.05 wt. % Cr, the balance being Al, incidental elements and impurities, wherein said aerospace structural component is selected from the group consisting of a spar member, rib member, web member, stringer member, wing panel member, wing skin member, fuselage frame member, floor beam member, bulkhead member and landing gear beam member.

2. The aerospace structural component of claim 1 wherein said alloy contains 0.05 to 0.3 wt. % Zr.

3. The aerospace structural component of claim 1 which is at least about 2 inches at its thickest cross sectional point.

4. The aerospace structural component of claim 3 which is about 3 to 10 inches at said thickest point.

5. The aerospace structural component of claim 1 wherein wt. % Mg≦(wt. % Cu+0.2).

6. The aerospace structural component of claim 1, which contains 7.00 to 9.00 wt. % Zn, 1.30 to 1.68 wt. % Mg and 1.30 to 1.90 wt. % Cu.

7. The aerospace structural component of claim 1 which is a thin plate about 2 inches thick or less.

8. The aerospace structural component of claim 7 which further exhibits improved exfoliation corrosion resistance.

9. The aerospace structural component of claim 7, whose manufacture includes age forming.

10. The aerospace structural component of claim 1 wherein said alloy contains about 0.08 wt. % or less Fe and about 0.06 wt. % or less Si.

11. The aerospace structural component of claim 1 wherein said alloy contains 0.04 wt. % maximum Fe and 0.03 wt. % maximum Si.

12. The aerospace structural component of claim 1 wherein said alloy contains 7.00 to 8.50 wt. % Zn; 1.30 to 1.68 wt. % Mg; 1.30 to 1.90 wt. % Cu and 0.05 to 0.20 wt. % Zr.

13. The aerospace structural component of claim 1 which is less than about 50% recrystallized.

14. The aerospace structural component of claim 13 which is about 35% or less recrystallized.

15. The aerospace structural component of claim 14 which is about 25% or less recrystallized.

16. The aerospace structural component of claim 1 which is welded to a second component and exhibits in its heat affected, welding zone an improved retention of one or more properties selected from the group consisting of: strength, fatigue, fracture toughness and corrosion resistance.

17. The aerospace structural component of claim 16 which is welded by a solid state method.

18. The aerospace structural component of claim 16 which is welded by friction stir welding.

19. The aerospace structural component of claim 16 which is welded by a fusion welding method.

20. The aerospace structural component of claim 16 which is welded by an electron beam method.

21. The aerospace structural component of claim 16 which is welded by a laser method.

22. The aerospace structural component of claim 16 wherein said second component is made of substantially the same alloy to which it is welded.

23. The aerospace structural component of claim 1 wherein said alloy has been artificially aged by a method comprising:

(i) a first aging stage within about 200 to 275° F.; and (ii) a second aging stage within about 300 to 335° F.

24. The aerospace structural component of claim 1 which is less than 2 inches thick.

25. The aerospace structural component of claim 1 which is at least 2 inches thick at its thickest point.

26. The structural component according to claim 1 which is a rolled product less than 2 inches thick.

27. An aerospace structural component made from an aluminum alloy product that in solution heat treated, quenched, and artificially aged condition possesses an improved combination of strength and toughness along with good corrosion resistance properties, said alloy consisting essentially of:

7.00 to 8.50 wt. % Zn; 1.30 to 1.68 wt. % Mg; 1.30 to 1.90 wt. % Cu; about 0.05 to 0.3 wt. % Zr; less than 0.1 wt. % Mn, less than 0.05 wt. % Cr, the balance being Al, incidental elements and impurities, wherein said aerospace structural component is selected from the group consisting of a spar member, rib member, web member, stringer member, wing panel member, wing skin member, fuselage frame member, floor beam member, bulkhead member and landing gear beam member.

28. The aerospace structural component of claim 27 wherein said alloy contains not more than 0.15 wt. % Fe and not more than 0.12 wt. % Si.

29. The aerospace structural component of claim 27 wherein said alloy contains 8 wt. % maximum Zn, and 1.30 to 1.65 wt. % Mg.

30. The aerospace structural component of claim 27 which is made from an alloy product that has, at a point 2 inches or more thick in cross section, a quarter-plane (T/4) tensile yield strength TYS in the longitudinal (L) direction and a quarter-plane (T/4) plane-strain fracture toughness ($K_{Ic}$) in the L-T direction at or above, or to the right of, or both above and to the right of, line M—M in FIG. 7.

31. The aerospace structural component of claim 27 which is made from a plate product having a minimum open-hole fatigue life (S/N) at one or more of the applied maximum stress levels set forth in Table 12 equal to or greater than the corresponding cycles to failure value in said Table 12.

32. The aerospace structural component of claim 27 which is made from a plate product having a minimum open hole fatigue life (S/N) at or above, or to the right of, or both above and to the right of, line A—A in FIG. 12.

33. The aerospace structural component of claim 27 which is made from a forging having a minimum open hole fatigue life (S/N) at, or above, or to the right of, or both above and to the right of, line B—B in FIG. 13.

34. The aerospace structural component of claim 27 which is made from a product that has a maximum fatigue crack growth (FCG) rate in the L-T test orientation at or below at least one of the maximum da/dN values set forth in Table 14 for the corresponding ΔK (stress intensity factor) values at or greater than 15 ksi√in in said Table 14.

35. The aerospace structural component of claim 27 which is made from a product that has a maximum fatigue crack growth (FCG) rate in the L-T test orientation for a ΔK of 15 ksi√in or more at, or below, or to the right of, or both below and to the right of, line C—C in FIG. 14.

36. The aerospace structural component of claim 27 which is made from a product that is capable of passing at least 30 days of alternate immersion, stress corrosion cracking (SCC) testing with a 3.5% NaCl solution at a short transverse (ST) stress level of about 30 ksi or more.

37. The aerospace structural component of claim 27 which is made from a product that has a minimum life without failure against stress corrosion cracking after at least about 100 days of seacoast exposure at a short transverse (ST) stress level of about 30 ksi or more.

38. The aerospace structural component of claim 37 which is made from a product that has a minimum life without failure against stress corrosion cracking after at least about 180 days of said seacoast exposure conditions.

39. The aerospace structural component of claim 27 which is made from a product that has a minimum life without failure against stress corrosion cracking after at least about 180 days of industrial exposure at a short transverse (ST) stress level of about 30 ksi or more.

40. The aerospace structural component of claim 27 which is made from a product that has both thick and thin sections after one or more machining operations are performed thereon, said thin sections exhibiting EXCO corrosion resistance rating of "EB " or better.

41. The aerospace structural component of claim 27 which is made from a product that exhibits an improved resistance to hole crack initiation.

42. The aerospace structural component of claim 27 wherein said alloy has been artificially aged by a method comprising:

(i) a first aging stage within about 200 to 275° F.;

(ii) a second aging stage within about 300 to 335° F.; and (iii) a third aging stage within about 200 to 275° F.

43. The aerospace structural component of claim 42 wherein first aging stage (i) proceeds within about 230 to 260° F.

44. The aerospace structural component of claim 42 wherein first aging stage (i) proceeds for about 2 to 18 hours.

45. The aerospace structural component of claim 42 wherein second aging stage (ii) proceeds within about 300 to 325° F.

46. The aerospace structural component of claim 42 wherein second aging stage (ii) proceeds for about 4 to 18 hours within about 300 to 325° F.

47. The aerospace structural component of claim 46 wherein second aging stage (ii) proceeds for about 6 to 18 hours within about 300 to 315° F.

48. The aerospace structural component of claim 46 wherein second aging stage (ii) proceeds for about 7 to 15 hours within about 310 to 325° F.

49. The aerospace structural component of claim 42 wherein third aging stage (iii) proceeds within about 230 to 260° F.

50. The aerospace structural component of claim 49 wherein third aging stage (iii) proceeds for at least about 2 hours within about 230 to 260° F.

51. The aerospace structural component of claim 50 wherein third aging stage (iii) proceeds for about 18 hours or more within about 240 to 255° F.

52. The aerospace structural component of claim 42 wherein one or more of said first, second and third aging stages includes an integration of multiple temperature aging effects.

53. The aerospace structural component of claim 27 which is made from a stepped extrusion.

54. The aerospace structural component of claim 27 which is made from an extrusion that has been press quenched.

55. The aerospace structural component of claim 27 which is made from a plate product and whose manufacture includes age forming.

56. An aluminum alloy structural component for an aircraft, which is selected from the group consisting of a spar member, rib member, web member, stringer member, wing panel member, wing skin member, fuselage frame member, floor beam member, bulkhead member, and landing gear beam member, said structural component made from a rolled, extruded, or forged alloy product, said alloy being solution heat treated, quenched and artificially aged, said structural component possessing an improved combination of strength, toughness and stress corrosion cracking resistance properties, said alloy consisting essentially of:

7 to 9.5 wt. % Zn; 1.3 to 1.68 wt. % Mg; 1.3 to 1.9 wt. % Cu; and 0.05 to 0.3 wt. % Zr, less than 0.1 wt. % Mn, less than 0.05 wt. % Cr, the balance Al, incidental elements and impurities.

57. The structural component of claim 56, wherein the manufacture of said structural component includes integral forming.

58. The structural component of claim 56 which has a maximum fatigue crack growth (FCG) rate in the L-T test orientation for a $\Delta K$ (stress intensity factor) of 15 ksi$\sqrt{\text{in}}$ or more at, or below, or to the right, of or both below and to the right of, line C—C in FIG. 14.

59. The structural component of claim 56 which is capable of passing at least 30 days of alternate immersion, stress corrosion cracking (SCC) testing with a 3.5% NaCl solution at a short transverse (ST) stress level of about 30 ksi or more.

60. The structural component of claim 56 which has a minimum life without failure against stress corrosion cracking after at least about 100 days of seacoast exposure at a short transverse (ST) stress level of about 30 ksi or more.

61. The structural component of claim 56, which has a minimum life without failure against stress corrosion cracking after at least about 180 days of industrial exposure at a short transverse (ST) stress level of about 30 ksi or more.

62. The structural component of claim 56 which has both thick and thin sections, said thin sections exhibiting an EXCO corrosion resistance rating of "EB" or better.

63. The structural component of claim 56 which exhibits an improved resistance to hole crack initiation.

64. The structural component of claim 56 wherein at least some of said artificial aging is performed on said rolled, extruded or forged alloy product prior to making such into said structural component.

65. The structural component of claim 56 wherein at least some of said artificial aging is performed after or during at least some shaping or forming operations performed on said alloy product in making said structural component.

66. The structural component of claim 56 wherein said extruded, rolled or forged alloy product is stretched and/or compressed prior to being artificially aged.

67. The structural component of claim 56 wherein said alloy is artificially aged by a method comprising:

(i) a first aging stage within about 200 to 275° F.;

(ii) a second aging stage within about 300 to 335° F.; and (iii) a third aging stage within about 200 to 275° F.

68. The structural component of claim 67 wherein first aging stage (i) proceeds within about 230 to 260° F.

69. The structural component of claim 68 wherein first aging stage (i) proceeds for 6 hours or more within about 235 to 255° F.

70. The structural component of claim 67 wherein first aging stage (i) proceeds for about 2 to 18 hours.

71. The structural component of claim 67 wherein second aging stage (ii) proceeds for about 4 to 18 hours within about 300 to 325° F.

72. The structural component of claim 71 wherein second aging stage (ii) proceeds for about 6 to 18 hours within about 300 to 315° F.

73. The structural component of claim 71 wherein second aging stage (ii) proceeds for about 7 to 15 hours within about 310 to 325° F.

74. The structural component of claim 67 wherein third aging stage (iii) proceeds for at least 2 hours within about 230 to 260° F.

75. The structural component of claim 74 wherein third aging stage (iii) proceeds for 18 hours or more within about 240 to 255° F.

76. An aircraft structural component selected from the group consisting of: a spar member, rib member, web member, stringer member, wing panel member, wing skin member, fuselage frame member, floor beam member, bulkhead member, landing gear beam member, said component having been made from a thick plate, extrusion or forging by operations comprising machining, and having improved strength, fracture toughness and corrosion resistance properties, said alloy consisting essentially of:

7 to 9.5 wt. % Zn; 13 to 1.68 wt. % Mg; 1.3 to 1.9 wt. % Cu; and 0.05 to 0.3 wt. % Zr, less than 0.1 wt. % Mn, less than 0.05 wt. % Cr, the balance Al, incidental elements and impurities.

77. The structural component of claim 76, wherein said alloy contains 0.15 wt. % maximum Fe and 0.12 wt. % maximum Si.

78. The structural component of claim 76 which is welded to a second structural component and exhibits an improved retention of one or more properties selected from the group consisting of: strength, fatigue, fracture toughness and corrosion resistance in its heat affected, welding zone.

79. The aircraft structural component of claim 76, said alloy being solution heat treated, quenched and artificially aged.

80. The aircraft structural component of claim 76 wherein said plate, extrusion or forged product is between about 2 to 12 inches at its thickest cross sectional point.

81. An aircraft wingbox component made from an aluminum alloy rolled, extruded or forged product, said alloy consisting essentially of:

7 to 8.5 wt % Zn; 1.3 to 1.68 wt. % Mg; 1.3 to 1.9 wt. % Cu; and about 0.05 to 0.25 wt. % Zr, less than 0.1 wt. % Mn, less than 0.05 wt. % Cr, the balance Al, incidental elements and impurities, wherein said wingbox component is selected from the group consisting of a spar member, rib member, web member, stringer member, wing panel member, and wing skin member.

82. The wingbox component of claim 81 whose manufacture includes age forming.

83. The wingbox component of claim 81 which is made from a stepped extrusion including a thickness greater than 2 inches.

84. The wingbox component of claim 81 which is made from a press quenched extrusion.

85. The wingbox component of claim 81 which is welded to a second wingbox component and exhibits in its heat affected, welding zone an improved retention of one or more properties selected from the group consisting of: strength, fatigue, fracture toughness and stress corrosion cracking resistance.

86. The wingbox component of claim 81 wherein said rolled, extruded or forged product was solution heat treated and intentionally quenched slowly.

87. The wingbox component of claim 81 which has a region 2 inches or more thick in cross section, said region having a quarter-plane (T/4) tensile yield strength TYS in the longitudinal (L) direction and a quarter-plane (T/4) fracture toughness ($K_{Ic}$) in the L-T direction at or above line M—M in FIG. 7, or at or to the right of said line M—M, or both above and to the right of said line M—M.

88. The wingbox component of claim 81 which is plate-derived and has a minimum open hole fatigue life (S/N) at or above line A—A in FIG. 12, or at or to the right of said line A—A, or both above and to the right of said line A—A.

89. The wingbox component of claim 81 which is forging-derived and has a minimum open hole fatigue life (S/N) at or above line B—B in FIG. 13, or at or to the right of said line B—B, or both above and to the right of said line B—B.

90. The wingbox component of claim 81 which has a maximum fatigue crack growth (FCG) rate in the L-T test orientation for a ΔK (stress intensity factor) of 15 ksi√in or more at or below line C—C in FIG. 14, or to the right of said line C—C, or both below and to the right of said line C—C.

91. The wingbox component of claim 81 which is capable of passing at least 30 days of alternate immersion, stress corrosion cracking (SCC) testing with a 3.5% NaCl solution at a short transverse (ST) stress level of about 30 ksi or more.

92. The wingbox component of claim 81 which has a minimum life without failure against stress corrosion cracking after at least about 100 days of seacoast exposure at a short transverse (ST) stress level of about 30 ksi or more.

93. The wingbox component of claim 92 which has a minimum life without failure against stress corrosion cracking after at least about 180 days of said seacoast exposure conditions.

94. The wingbox component of claim 81 which has a minimum life without failure against stress corrosion cracking after at least about 180 days of industrial exposure at a short transverse (ST) stress level of about 30 ksi or more.

95. The wingbox component of claim 81 which has both thick and thin sections, said thin sections exhibiting an EXCO corrosion resistance rating of "EB" or better.

96. The wingbox component of claim 81 which exhibits an improved resistance to hole crack initiation.

97. An aircraft wingbox component made from an aluminum alloy plate, extrusion or forged product, said alloy consisting essentially of:

7 to 8.5 wt. % Zn; 1.3 to 1.68 wt. % Mg; 1.3 to 1.9 wt. % Cu; and about 0.05 to 0.25 wt. % Zr, less than 0.1 wt. % Mn, less than 0.05 wt. % Cr, the balance Al, incidental elements and impurities, wherein the wingbox component is an integral spar made from an alloy product at least 2 inches thick at its thickest cross sectional point.

98. An aircraft wingbox component made from an aluminum alloy plate, extrusion or forged product, said alloy consisting essentially of:

7 to 8.5 wt. % Zn; 1.3 to 1.68 wt. % Mg; 1.3 to 1.9 wt. % Cu; and about 0.05 to 0.25 wt. % Zr, less than 0.1 wt. % Mn, less than 0.05 wt. % Cr, the balance Al, incidental elements and impurities wherein the wingbox component is a rib member, web member or stringer member.

99. An aircraft wingbox component made from an aluminum alloy rolled, extruded or forged product, said alloy consisting essentially of:

7 to 8.5 wt. % Zn; 1.3 to 1.68 wt. % Mg; 1.3 to 1.9 wt. % Cu; and about 0.05 to 0.25 wt. % Zr, less than 0.1 wt. % Mn, less than 0.05 wt. % Cr, the balance Al, incidental elements and impurities, wherein the wingbox component is a wing panel or skin.

100. The wingbox component of claim 99 whose manufacture includes age forming.

101. An aircraft wing assembly including a wingbox structure comprised of spaced apart upper and lower wing skin members, at least one of said skin members including a plurality of stringer reinforcements, said wingbox structure further including spar members bridging said wing skins, at least one of said spar members being an integral spar member made by removing substantial quantities of metal from an aluminum product made from an alloy consisting essentially of:

7 to 8.5 wt. % Zn; 1.3 to 1.68 wt. % Mg; 1.3 to 1.9 wt. % Cu, and 0.05 to 0.3 wt. % Zr, less than 0.1 wt. % Mn, less than 0.05 wt. % Cr, the balance being Al, incidental elements and impurities.

102. An aircraft wing assembly including a wingbox comprised of spaced apart upper and lower wing skins, at least one of said skins including a plurality of stringer reinforcements, at least one of said skins having an integral stringer reinforcement made by removing substantial quantities of metal from a wrought product, the alloy of which consists essentially of:

7 to 8.5 wt. % Zn; 1.3 to 1.68 wt. % Mg; 1.3 to 1.9 wt. % Cu, and 0.05 to 0.3 wt. % Zr, less than 0.1 wt. % Mn, less than 0.05 wt. % Cr, the balance Al, incidental elements and impurities.

103. An aircraft having a plurality of airframe structural components made from aluminum alloy workpieces, the alloy of which consists essentially of: 7 to 8.5 wt. % Zn; 1.3 to 1.68 wt. % Mg; 1.3 to 1.9 wt. % Cu, and 0.05 to 0.3 wt. % Zr, less than 0.1 wt. % Mn, less than 0.05 wt. % Cr, the balance Al, incidental elements and impurities, wherein said structural components are selected from the group consisting of: a spar, rib, web, stringer, wing panel, wing skin, fuselage frame, floor beam, bulkhead, landing gear beam.

104. The aircraft of claim 103 wherein said alloy has been artificially aged by a method comprising:

(i) a first aging stage within about 200 to 275° F.;

(ii) a second aging stage within about 300 to 335° F.; and (iii) a third aging stage within about 200 to 275° F.

105. The aircraft of claim 104 wherein first aging stage (i) proceeds within about 230 to 260° F.

106. The aircraft of claim 104 wherein first aging stage (i) proceeds for about 2 to 18 hours.

107. The aircraft of claim 104 wherein second aging stage (ii) proceeds within about 300 to 325° F.

108. The aircraft of claim 104 wherein second aging stage (ii) proceeds for about 4 to 18 hours within about 300 to 325° F.

109. The aircraft of claim 104 wherein second aging stage (ii) proceeds for about 6 to 18 hours within about 300 to 315° F.

110. The aircraft of claim 104 wherein second aging stage (ii) proceeds for about 7 to 15 hours within about 310 to 325° F.

111. An aircraft having several structural components made by removing substantial quantities of metal from aluminum workpieces, the alloy of which consists essentially of:

7 to 8.5 wt. % Zn; 1.3 to 1.68 wt. % Mg; 1.3 to 1.9 wt. % Cu, and 0.05 to 0.3 wt. % Zr, less than 0.1 wt. % Mn, less than 0.05 wt. % Cr, the balance Al, incidental elements and impurities, wherein at least one of said components is a bulkhead member.

112. An aircraft having a plurality of large structural components made by removing substantial quantities of metal from aluminum workpieces, the alloy of which consists essentially of:

7 to 8.5 wt. % Zn; 1.3 to 1.68 wt. % Mg; 1.3 to 1.9 wt. % Cu, and 0.05 to 0.3 wt. % Zr, less than 0.1 wt. % Mn, less than 0.05 wt. % Cr, the balance Al, incidental elements and impurities, wherein two or more of said components are wing spar members.

113. An aluminum alloy aerospace wrought structural component less than 2 inches thick at its thickest point, that in solution heat treated, quenched, and artificially aged condition, possesses an improved combination of strength and toughness along with good corrosion resistance properties, said alloy consisting essentially of:

7.0 to 8.5 wt. % Zn; 1.3 to 1.68 wt. % Mg; 1.3 to 1.9 wt. % Cu, 0.05 to 0.3 wt. % Zr; less than 0.1 wt. % Mn; less than 0.05 wt. % Cr, the balance being Al, incidental elements and impurities, wherein said component is selected from the group consisting of a spar member, rib member, web member, stringer member, wing panel member, wing skin member, fuselage frame member, floor beam member, bulkhead member, and landing gear beam member.

114. The structural component of claim 113 wherein said alloy contains 7.00 to 8.00 wt. % Zn, 1.30 to 1.68 wt. % Mg, and 1.30 to 1.90 wt. % Cu.

115. The structural component of claim 113 which is made from a plate product having a minimum open-hole fatigue life (S/N) at one or more of the applied maximum stress levels set forth in Table 12 equal to or greater than the corresponding cycles to failure value in said Table 12.

116. The structural component of claim 113 which is made from a plate product having a minimum open-hole fatigue life (S/N) at or above line A—A in FIG. 12, or to the right of said line A—A, or both above and to the right of said line A—A.

117. The structural component of claim 113 which is made from a forging having a minimum open hole fatigue life (S/N) at or above line B—B in FIG. 13, or to thy right of said line B—B, or both above and to the right of said line B—B.

118. The structural component of claim 113 which is made from an alloy product that has a maximum fatigue crack growth (FCG) rate in the L-T test orientation at or below at least one of the maximum da/dN values set forth in Table 14 for the corresponding ΔK (stress intensity factor) values at or greater than 15 ksi√in in said Table 14.

119. The structural component of claim 113 which is made from an alloy product that has a maximum fatigue crack growth (FCG) rate in the L-T test orientation for a ΔK of 15 ksi√in or more at or below line C—C in FIG. 14, or to the right of said line C—C, or both below and to the right of said line C—C.

120. The structural component of claim 113 which is made from an alloy product that is capable of passing at least 30 days of alternate immersion, stress corrosion cracking (SCC) testing with a 3.5% NaCl solution at a short transverse (ST) stress level of about 30 ksi or more.

121. The structural component of claim 113 comprising 2 spaced panels or skin members spaced apart by bridging members, said component being one or more of said members.

122. An aircraft wing including a wingbox comprised of upper and lower wing skins, at least one of said skins having a plurality of stringer reinforcements, at least one of said skins being made from an alloy which consists essentially of:

7.0 to 8.5 wt. % Zn; 1.3 to 1.68 wt. % Mg; 1.3 to 1.9 wt. % Cu, and about 0.05 to 0.3 wt. % Zr, less than 0.1 wt. % Mn, less than 0.05 wt. % Cr, the balance Al, incidental elements and impurities, said alloy being artificially aged.

123. The wing of claim 122 wherein both upper and lower wing skins are made of said alloy.

124. The wing of claim 122 wherein the lower wing skins is made of said alloy.

125. The wing of claim 122 wherein the upper wing skin is made from said alloy.

126. The wing of claim 122 wherein at least one of the stringer reinforcements are made from said alloy.

127. The wing of claim 126 wherein said stringer reinforcement is integral with a wingskin.

128. An aircraft wing assembly including a wingbox comprised of structural components, selected from the group consisting of upper and lower wing skins member, a spar member, rib member, web member, stringer member, wing panel member, and wing skin member, at least one said structural components being made from an aluminum alloy which consists essentially of:

7 to 8.5 wt. % Zn; 1.3 to 1.68 wt. % Mg; 1.3 to 1.9 wt. % Cu, and 0.05 to 0.3 wt. % Zr, less than 0.1 wt. % Mn, less than 0.05 wt. % Cr, the balance Al, incidental elements and impurities.

* * * * *